United States Patent [19]

Niederhauser

[11] 4,190,695

[45] Feb. 26, 1980

[54] HYDRAULICALLY NEEDLING FABRIC OF CONTINUOUS FILAMENT TEXTILE AND STAPLE FIBERS

[75] Inventor: Donald O. Niederhauser, Wilmington, Del.

[73] Assignee: E. I. Du Pont de Nemours and Company, Wilmington, Del.

[21] Appl. No.: 965,072

[22] Filed: Nov. 30, 1978

[51] Int. Cl.[2] ..... D04H 3/08

[52] U.S. Cl. ..... 428/234; 28/104; 28/105; 428/193; 428/235; 428/284; 428/286; 428/300

[58] Field of Search ..... 428/234, 235, 284, 286, 428/300, 137, 193; 28/104, 105

[56] References Cited

U.S. PATENT DOCUMENTS

| | | | |
|---|---|---|---|
| 3,068,547 | 12/1962 | L'Hommedieu | 19/145 |
| 3,129,466 | 4/1964 | L'Hommedieu | 19/145 |
| 3,214,819 | 11/1965 | Guerin | 428/300 |
| 3,485,706 | 12/1969 | Evans | 428/296 |
| 3,494,821 | 2/1970 | Evans | 428/296 |
| 3,508,308 | 4/1970 | Bunting | 28/78 |

FOREIGN PATENT DOCUMENTS

| | | | |
|---|---|---|---|
| 739652 | 8/1966 | Canada | 428/296 |
| 841938 | 5/1970 | Canada | 428/296 |
| 1063252 | 3/1967 | United Kingdom | 428/296 |
| 1063253 | 3/1967 | United Kingdom | 428/296 |

*Primary Examiner*—Marion E. McCamish

[57] ABSTRACT

A lightweight composite fabric characterized by high retention of fiber content during initial laundering and exceptionally high strength as measured close to the edge of the fabric with cover and fabric aesthetics equivalent to conventional fabrics having 50% higher basis weight are produced by hydraulically needling short staple fibers and a substrate of continuous filaments formed into an ordered cross-directional array. The individual continuous filaments of the array are well spread and separated so that they have a spaced-apart relationship allowing interentangling of the short staple fibers with the continuous filaments to form more than about two reversals in the staple fibers per cm of staple fiber length between the faces of the fabric. The staple fibers have a linear density of less than about 0.3 tex per filament, are from about 0.5 cm to about 1 cm in length and comprise about 20% to about 50% of the weight of the composite fabric.

8 Claims, 34 Drawing Figures

HYDRAULICALLY NEEDLING FABRIC OF CONTINUOUS FILAMENT TEXTILE AND STAPLE FIBERS

DESCRIPTION

1. Technical Field

This invention relates to composite fabrics and more particularly, it relates to lightweight composite fabrics suitable for general purpose wearing apparel.

2. Background Art

Lightweight fabrics having good cover, strength, and other aesthetics appropriate for the indicated end use are highly desired in the marketplace, especially when the weight of the fabric can be reduced while still maintaining the desired fabric properties. In commercial practice, of course, a range of fabric weights is offered for sale in each end-use category. While the final customer is the ultimate judge of quality, there is a minimum optimum weight in each end-use category at which fabrics can be expected to have good cover, stability, body, and other attributes of good quality.

Nonwoven fabrics are of interest because of their low cost of manufacture. For several years nonwoven fabrics made entirely of staple fibers, either with a pattern of apertures by the process of Evans U.S. Pat. No. 3,485,706 or without apertures by the process of Bunting et al. U.S. Pat. No. 3,508,308, have been produced commercially. Such fabrics have found widespread utility in such applications as household drapes, bedspreads, mattress covers, diapers, and disposable wearing apparel such as operating room scrub suits. Many of these are relatively lightweight fabrics. However, regardless of their basis weight, these fabrics have not penetrated the general purpose wearing apparel market, owing to their poor seam strength, poor stability, and high fiber loss during laundering.

The reinforcement of nonwoven fabrics by incorporating into them one or more layers of woven fabric, knit fabric, random nonwoven webs of continuous filaments, or warps or cross-warps of continuous filaments or yarns thereof is disclosed in Evans U.S. Pat. No. 3,485,706, Evans U.S. Pat. No. 3,494,821, and British Pat. Nos. 1,063,252–253. Canadian Pat. No. 841,938 similarly discloses reinforcement of absorbent nonwoven fabrics of paper fibers of short length by assembling the layers of paper fibers with woven, nonwoven, or knitted fabrics and uniting the layers into a laminated structure. However, the deficiencies of nonwoven fabrics made entirely of staple fibers are not fully resolved by reinforcing them with continuous filament fabrics or cross warps in the ways disclosed in the prior art. In particular, excessive loss of staple fiber during the initial laundering of the fabric is a problem. Higher strength very near the edge of the fabric, i.e., within about 3 mm of the edge, is also desired so that the fabric will form strong seams.

SUMMARY OF THE INVENTION

In accordance with the present invention, lightweight composite fabrics are provided which have excellent retention of staple fibers during laundering, including the initial laundering, and which have an edge strength superior to conventional woven and knitted fabrics of the same weight. The cover and fabric aesthetics provided by the composite fabrics of the invention are equivalent to those of conventional woven and knitted fabrics of 50% higher basis weight.

The lightweight composite fabrics of the invention are produced by a hydraulic needling process from short staple fibers and a substrate of continuous filaments formed into an ordered cross-directional array by ensuring that the individual filaments are well spread and separated so that they have a spaced-apart relationship and interentangling the short staple fibers with the continuous filaments while they are spaced apart, first from one side of the fabric and then from the other, to form more than about two reversals in the staple fibers per cm of staple fiber length between the faces of the fabric. The filaments are considered well spread provided that the average spacing between any bundles of filaments is no larger than the average width of said bundles of filaments; and they are considered to have a spaced-apart relationship provided that in the densest observed area of the filament bundle the sum of the areas of the filament cross sections occupies less than 30% of the densest observed area of the bundle. The individual continuous filaments are thus interpenetrated by the short staple fibers and locked in place by the high frequency of staple fiber reversals. The staple fibers should have a linear density of less than about 0.3 tex per filament, should be from 0.5 cm to about 1 cm in length, and should comprise from 20 to 50% of the weight of the composite fabric. The substrate should be comprised of yarns or warps of continuous filaments, formed into an ordered cross-directional array, which are free of filament interentanglement which would prevent ready separation of the filaments from one another.

As used herein, the term "cross-directional array" designates a filament pattern in which a first set of continuous filaments is disposed in a first direction from one side of the pattern to the other in such a way that the filaments maintain approximately the same distances from one another from one side of the pattern to the other, while in a direction which crosses the first direction (preferably at right angles) the first set of continuous filaments is either (a) knitted together in stitches aligned across the pattern in the second direction or (b) crossed in the second direction by a second set of continuous filaments which maintain approximately the same distance from one another as they proceed from one side of the pattern to the other in the second direction. One form of the cross-directional array is therefore a knitted fabric of continuous filament yarns, preferably a jersey knit construction. Another form of the cross-directional array is a woven scrim formed of continuous filament yarns. Still another form of the cross-directional array is a cross-warp of continuous filaments, especially one in which the cross-warp is formed in at least one direction from continuous filament yarns spread out to expose individual filaments.

The product of the invention is a light-weight composite fabric comprising: a substrate of continuous filaments formed into an ordered cross-directional array, said continuous filaments having a spaced-apart relationship visible throughout the array in at least one direction of the array, said filaments being well spread provided that the average spacing between any bundles of filaments is no larger than the average width of said bundles of filaments, said filaments having a spaced-apart relationship provided that in the densest observed area of the filament bundle the sum of the areas of the filament cross sections occupies less than 30% of the densest observed area of the bundle, said substrate being combined with staple fibers of less than 0.3 tex per filament and from about 0.5 cm to about 1 cm in length in the amount of from 20 to 50% of the weight of the composite fabric, said staple fibers extending through and entangled with said continuous filaments and having more than about two reversals in direction between the faces of the fabric per cm of staple fiber length; said composite fabric having an edge strength of from about 15 to 30 newtons and experiencing a loss of no more than 3% of its fiber content during initial laundering. The fabric preferably has a basis weight of from about 50 to about 135 grams per square meter.

One embodiment of the invention is such a lightweight composite fabric in which the substrate is formed of continuous filament yarns knit together in stitches in an ordered array of courses and wales, said substrate having a construction density of from about 0.2 to about 1.4 stitches×gram/cm$^4$.

In another embodiment of the invention the lightweight composite fabric has a substrate which is a woven scrim formed of continuous filament yarns and having from about 2 to 12 picks per inch.

In a further embodiment of the invention, the substrate is a cross-warp of continuous filaments, one of the cross-warps preferably being formed in at least one direction from continuous filament yarns.

In still another embodiment of the invention, the lightweight composite fabric of the invention is a corduroy fabric having a basis weight of from about 100 to about 200 grams per square meter, said substrate being a cross-warp of continuous filaments.

The process for making the lightweight composite fabrics of the invention comprises:

(a) forming continuous filament yarns into an ordered cross-directional array, said yarns being free of filament interentanglement and twist which would prevent ready separation of the filaments from one another;

(b) placing a sheet formed of staple fibers of less than 0.3 tex per filament and from about 0.5 cm to about 1 cm in length over said array of continuous filament yarns;

(c) impinging the staple fibers and array of continuous filament yarns with columnar streams of liquid to spread the yarns so that the filaments are well spread and have a spaced-apart relationship throughout the array in at least one direction and so that the staple fibers interentangle with said continuous filaments to form an integral composite fabric, said filaments being well spread provided that the average spacing between any bundles of filaments is no larger than the average width of said bundles of filaments, said filaments having a spaced-apart relationship provided that in the densest observed area of the filament bundle the sum of the areas of the filament cross sections occupies less than 30% of the densest observed area of the bundle; and (d) impinging the fabric so formed with columnar streams of liquid from the reverse side of the fabric to further interentangle the staple fibers, thereby forming more than about two reversals in the staple fibers in the direction between the faces of the fabric per cm of staple fiber length.

FIGS. **26, 26*a*** are photomicrographs at 10× magnification of face and back portions, respectively, of the fabric made according to Example 5.

DETAILED DESCRIPTION OF THE ILLUSTRATED EMBODIMENTS

Figure 1:
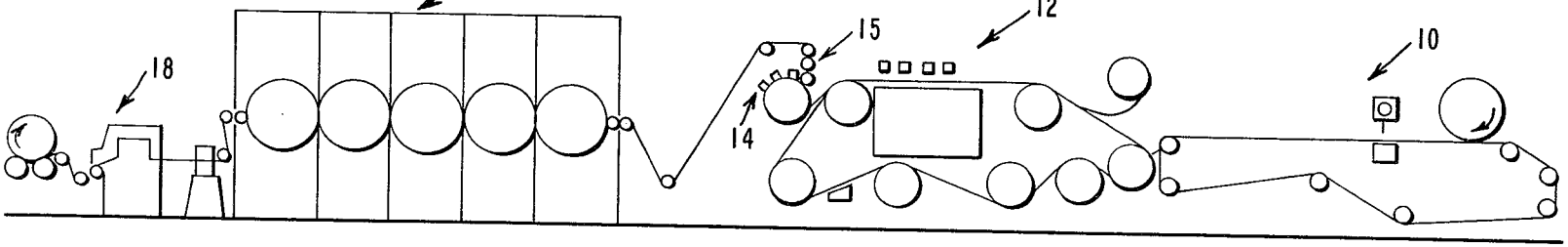
FIG. 1 is a schematic illustration of a process for making the fabric of the invention involving two stages of hydraulic needling.

FIG. 1 illustrates schematically a two-stage hydraulic needling process for making the fabric of the invention that generally includes as components an endless driven belt feed section 10, an endless driven belt needling section 12, a drum needling section 14 with squeeze roll section 15, a hot air dryer 16, and a windup 18. Details on the operating conditions are found in Example 1.

Figure 2:
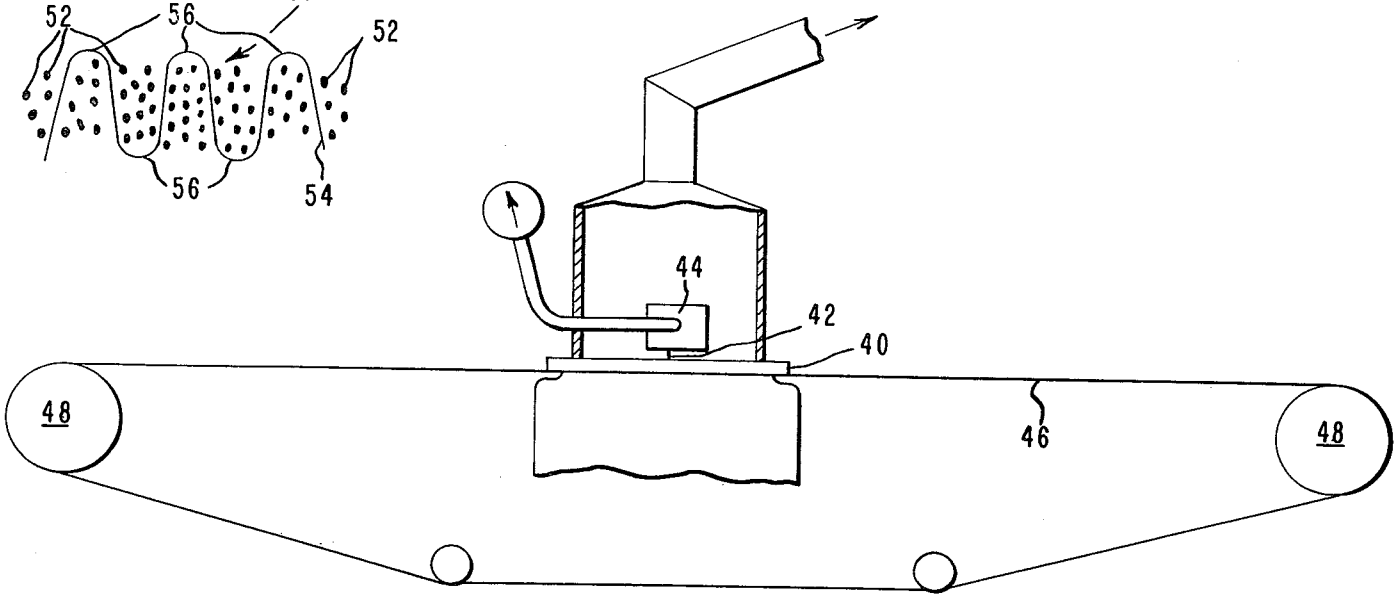
FIG. 2 is a schematic illustration of a process for making the fabric of the invention involving one stage of hydraulic needling.

FIG. 2 illustrates a single stage hydraulic needling process for making the fabric of this invention wherein a scrim fabric substrate and overlaid staple fibers assembled in frame 40 is passed beneath a line of closely spaced fine columnar streams of liquid 42 (only one of which is visible) from a manifold 44. The frame 40 is positioned on a reversibly movable endless belt 46 traveling in a path determined by rollers 48. The passage of the frame 40 beneath the streams 42 is in effect a traverse of the streams across the top of the staple/substrate assemblage. Again, further details on operating conditions are disclosed in Examples 2–5.

Figure 3:
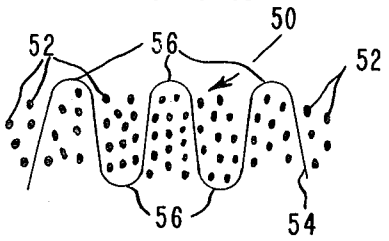
FIG. 3 is a schematic cross sectional representation of a fabric of the invention illustrating staple fiber reversals.

FIG. 3 is a cross sectional schematic view of the fabric 50 of the invention showing the continuous filaments 52 of the yarn in a well spread spaced-apart relationship permitting the staple fibers 54 to be intertangled with the filaments to form reversals 56 in the staple fiber.

The lightweight composite fabrics of the present invention comprise two components, the short staple fibers 54 and a substrate of continuous filaments 52 formed into an ordered cross-directional array. The fabrics of the invention are distinguished from prior art fabrics in that these components are integrated together so intimately that they form a single entity of a highly uniform nature, as contrasted with laminated or reinforced fabrics. The fabrics of the invention therefore are strong and have good cover and other good fabric aesthetics even though they are light in weight. In particular, they exhibit exceptionally high strength close to the edge of the fabric, a property associated with the ability to form strong seams. The novel fabrics also exhibit high retention of their fiber content, experiencing a loss of no more than 3% of their fiber content during initial laudering. Loose fibers which are not well integrated into the fabric structure tend to be lost during this initial laundering. Poorly integrated prior art fabrics have in some instances exhibited a fiber loss of 10% or more during initial laundering.

The continuous filament component of the fabric of the invention has as its most important characteristic the property of being of a spreadable nature. Warps of individual continuous filaments may be used where applicable. However, spreadable continuous filament yarns are commercially more practical for cross-warps and are required for embodiments involving woven or knitted scrims as substrates. Such continuous filament yarns cannot have appreciable twist, or have a significant content of entangled nodes to permanently entangle the filaments together, either of which would prevent the yarn from being spread and the filaments disassociated from one another so that the filaments have a spaced-apart relationship throughout the ordered cross-directional array in at least one direction. The spreading of the yarns has two important aspects: first, the process of spreading brings filaments of nearby yarns close together, closing the space between adjacent yarns, making the fabric more uniform, and increasing the cover; and second, gaps are opened between filaments within individual yarns which permit the short staple fibers to penetrate primarily between the filaments of individual yarns rather than between the yarn bundles. The staple fibers thus act to interentangle with individual continuous filaments to form a highly integrated, uniform composite fabric rather than to interentangle with yarn bundles to form a reinforced or laminated structure.

Preferred continuous filament yarns for forming the ordered cross-directional array are false-twist textured (FTT) or false-twist set textured (FTST) continuous filament yarns composed of polyester, polyamide, or other extrudable polymer.

The staple fiber component of the fabric of the invention can be of any fiber, natural or synthetic, such as cotton, rayon, polyester, acrylic, or nylon. The fibers should have a linear density of less than 0.3 tex per filament, e.g., in the range of about 0.05 to 0.3 tex per filament, and be present in the amount of 20 to 50% of the weight of the composite fabric. Most importantly, the staple fibers are short, having a length of from about 0.5 to about 1 cm in length; and in the hydraulic needling process the short staple fibers are needled first from one side of the fabric and then from the other until they have more than about 2 reversals between the faces of the fabric per cm of staple fiber length. Because the staple fibers interpenetrate individual continuous filaments, as described above, and because they are both short in length and have frequent reversals from one side of the fabric to the other, they act to interentangle the individual filaments to form a highly integrated, uniform composite fabric.

FIGS. 4–26 are photomicrographs at 10× magnification of portions of fabrics produced according to Examples 1–5.

DESCRIPTION OF TESTS

A. Reversal Frequency

This is a test to determine the frequency with which staple fibers passing from one side of the fabric to the other reverse themselves and pass through the fabric again. In this test, a sample is cut from the test fabric and placed between two sheets of transfer printing paper of different colors, described here as red and black. The resulting sandwich is hot pressed for 2.5 minutes at a temperature of 180° C. and at a pressure of about 7 MPa. This results in the samples being dyed red on one side and black on the other. In the dyed fabric, staple fibers that have passed through the fabric from one side to the other side one or more times will then have alternating black and red sections, sometimes with an intervening undyed section. To determine the reversal frequency of these staple fibers, individual staple fibers are teased out from the cut edge of the fabric. In a preferred form of the test, the sample is a 4×4 cm square and the fibers are pulled from the edges of a cut made through the middle of the dyed square of fabric (the cut preferably being made in the wale direction in the case of a knitted fabric). The fibers are then viewed under a stereomicroscope, and for each fiber, the total number N of dyed sections (number of red sections plus number of black sections) is noted. The number of reversals, R, of a staple fiber is two fewer than the total number of dyed sections: i.e., $$R=N-2 \qquad \text{Eq. (I)}$$

For instance, a fiber having three dyed sections has one reversal, a fiber with four dyed sections has two reversals, etc. The lengths of the individual staple fibers, if not already known because of information known about starting material fibers from which the fabric was made, are determined in centimeters. The reversal frequency for each individual staple fiber is then determined by dividing R by the length of the staple fiber. Results are obtained for approximately 100 individual staple fibers. The average of all the reversal length values is then determined and reported as the result for reversal frequency.

B. Basis Weight and Staple Fiber Composition

The weight and the area of a sample of fabric are measured, and the basis weight is determined by dividing the weight by the area, e.g., as expressed in units of $g/m^2$. The percentage staple fiber content, if not already known, is determined by carefully teasing apart a small sample of the fabric, separating the staple fibers from the continuous filaments, weighing the collected staple fibers together, dividing the weight of the staple fibers by the weight of the fabric sample, and expressing the result as a percentage value. The linear density of the staple fibers, if not already known, is determined in conventional manner by weighing a measured length of the staple fiber on a sensitive balance.

C. Knit Construction Density

This test is a measure of the tightness of construction of knit fabrics. In this test, the number of courses per centimeter and the number of wales per centimeter are determined. Knit construction density is defined and calculated as the product of the number of courses per cm, the number of wales per cm, and the fabric basis weight in $g/cm^2$. The knit construction density parameter accordingly has the dimensions of $g/cm^4$.

D. Test For Spreading of Filaments

In this test a photomicrograph of a representative area of the fabric sample is prepared and examined to determine whether the continuous filament bundles (i.e., yarns or other groups of continuous filaments) which form the substrate of the fabric have been adequately spread so that the short staple fibers project through extensive areas of the spread bundles, as contrasted with spaces between bundles. The sample is first inspected to determine whether it contains continuous filaments, and if so, whether these are arranged in an ordered cross-directional array (knit structure, woven structure, or cross-warp). Those samples which do contain an ordered cross-directional array of continuous filaments are handled further in accordance with the type of array present, as follows:

(D-1) Samples Having a Knit Construction of Continuous Filament Bundles

Figure 27:
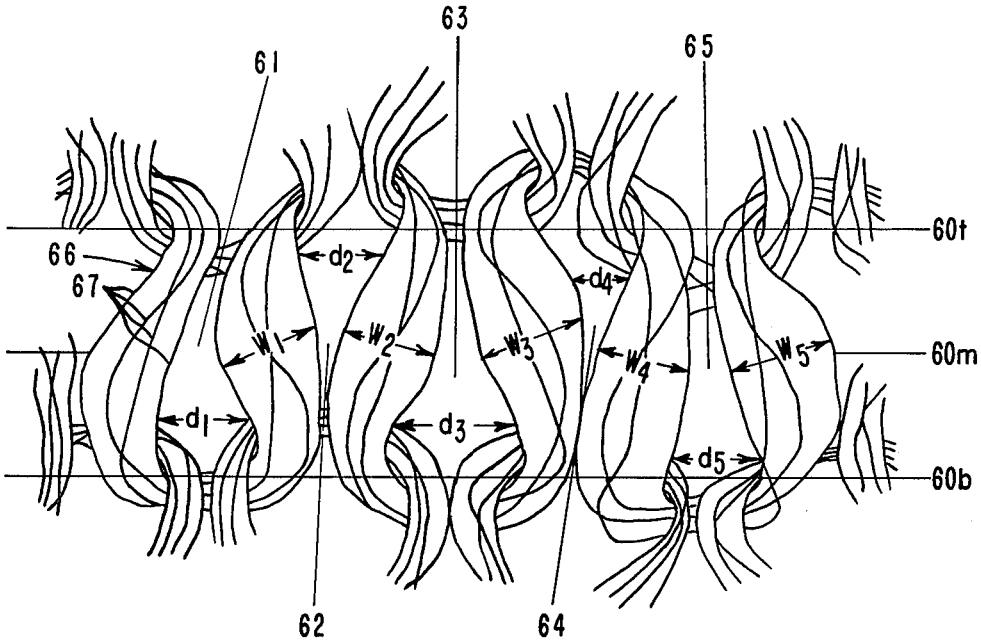

A photomicrograph at 10× magnification, taken from the wales side of the fabric by reflected light against a contrasting background, is prepared. One stitch near the center of the photomicrograph is arbitrarily selected as a reference stitch. Two parallel straight lines are drawn on the photomicrograph as guidelines, one line generally following the course direction at the top (arbitrarily selected) of the reference stitch and the other line generally following the course direction at the bottom of the reference stitch. FIG. 27 is a schematic illustration in which the stitches are shown as being formed from continuous filament bundles 66 comprised of four continuous filaments 67, the staple fibers in the fabric being omitted in this illustration. As illustrated in FIG. 27, guidelines **60*t* and 60*b* are drawn in the course direction at the top and bottom, respectively, of reference stitch 63 and measurements are then made on the reference stitch, the stitch 61 immediately to the left of it, and the stitch 65 immediately to the right of it—three stitches in all, encompassing five holes between the guidelines, one hole at the center of each of the three stitches and two holes 62 and 64** between stitches. For each of these holes, the maximum diameter of the hole between the guidelines, measured in a direction parallel to the guidelines, is determined. These diameters are shown as $d_1$, $d_2$, $d_3$, $d_4$ and $d_5$, where $d_3$ is the diameter of the hole in the reference stitch. The width of the continuous filament bundle at the right of each of the holes is then also determined, the measurement being made midway between the guidelines and across the continuous filament bundle perpendicular to the general direction in which the bundle lies. These widths are shown as $w_1$, $w_2$, $w_3$, $w_4$ and $w_5$. In some cases, the hole diameter may be zero (continuous filaments of the bundle on the right side of the stitch touching or overlapping the continuous filaments of the bundle on the left side of the stitch). The sum of the five bundle widths is calculated as $w_t$ and the sum of the five hole diameters is calculated separately as $d_t$. The degree of spreading, %S, is then calculated as a percentage in accordance with the equation $$\%S = \frac{w_t}{d_t + w_t} \times 100\% \qquad \text{Equation (II)}$$

In this test, the continuous filaments are considered to be adequately spread if, in at least one direction, the degree of spreading is at least 50% as calculated by Equation II. Although FIG. 27 illustrates a jersey knit, the test is carried out in analogous manner on five adjacent holes between course lines with other knit patterns.

(D-2) Samples Having a Woven Construction of Continuous Filament Bundles

Figure 28:
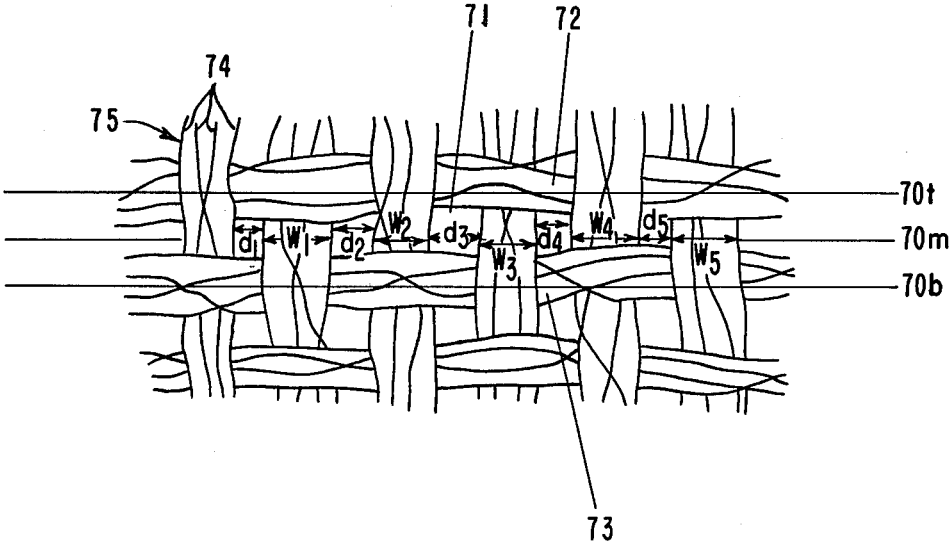

A photomicrograph at 10× magnification, taken from the face side of the fabric (the least fuzzy of the two sides) by reflected light against a contrasting background, is prepared. Near the center of the photomicrograph, a unit cell comprising the quadrilateral formed by the four crossover points of two adjacent continuous filament bundles (yarns) in each direction is selected as the reference unit cell. FIG. 28 is a schematic illustration in which the woven structure with reference unit cell 71 is shown as being formed from continuous filament bundles 75 comprised of four continuous filaments 74, the staple fibers in the fabric being omitted in this illustration. Two parallel straight guidelines are drawn, one line **70*t* generally following the center line of the continuous filament bundle 72 at the top (arbitrarily selected) of the reference unit cell and the other line 70*b* generally following the center line of the continuous filament bundle 73 at the bottom of the reference unit cell. As shown in FIG. 28, measurements are then made on the row of unit cells comprising the reference unit cell, the two unit cells immediately to the left of it, and the two unit cells immediately to the right of it (five unit cells in all, each sharing at least one side with another unit cell). For each of these unit cells, the maximum diameter of the hole near the center of the cell, measured in a direction parallel to the guidelines, is determined. For each of these cells, the width of the continuous filament bundle at the right of each of the holes is then also determined, the measurement being made across the bundle perpendicular to the general direction in which the bundle lies. In FIG. 28, as in FIG. 27**, the hole diameters are designated as $d_1$, $d_2$, etc. and the bundle widths are designated as $w_1$, $w_2$, etc. The sums of the bundle widths and the hole diameters are then calculated separately, after which the degree of spreading, S, is calculated in accordance with Equation II. If the degree of spreading determined in this way is less than 50%, the test is repeated with the same reference unit cell, using guidelines along the other sides of the unit cell in a cross direction to the original guidelines. In this test, the continuous filaments are considered to be adequately spread if, in at least one direction, the degree of spreading is at least 50% as calculated by Equation II.

(D-3) Samples Having Cross-Warps of Continuous Filaments

Figure 29:
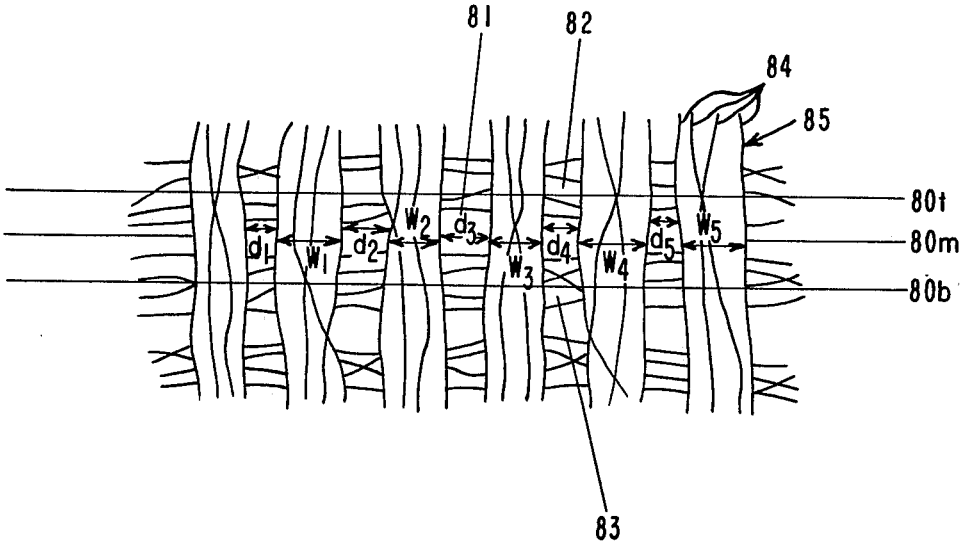

Photomicrographs at 10× magnification are taken of each side of the fabric by reflected light against a contrasting background. The photomicrographs are examined to determine whether the continuous filaments in the fabric appear to be divided in both the machine direction and in the cross direction into bundles of continuous filaments with intervening spaces (e.g., into yarns or other groups of continuous filaments). If, in at least one direction, there is no such division of the continuous filaments into bundles separated by spaces, the value of $d_t$ in Equation II is taken to be zero and the degree of spreading, S, is 100%. If the continuous filaments are divided in both directions into bundles of filaments with intervening spaces, as shown schematically in FIG. 29, the procedure described in Test D-2 for samples having a woven construction of continuous filament yarns is applied, bundles of filaments in the two cross directions being regarded as forming unit cells comprising quadrilaterals analogous to the unit cells in the woven construction. In FIG. 29 the cross-warp structure is shown as being formed from continuous filament bundles 85 comprised of four continuous filaments 84, the staple fibers in the fabric being omitted in this illustration. Two parallel straight guidelines 80t and 80b are drawn at the top (arbitrarily selected) and bottom of the reference unit cell 81 generally following the center lines of continuous filament bundles 82 and 83 defining the top and bottom of the cell. Measurements are taken on five unit cells in one direction, and, if necessary, in the other direction as described in Test D-2. In this test, the continuous filaments are considered to be adequately spread if, in at least one direction, the degree of spreading is at least 50% as calculated by Equation II.

In making observations with respect to any of the above samples, the pattern to be examined is that of the continuous filaments. Although staple fibers are also present and may not be conclusively distinguished from the continuous filaments in all cases, the general pattern of the continuous filaments can be ascertained and it is with respect to this pattern that the criteria of the test should be applied.

E. Test for Spaced-Apart Relationship of Filaments

In this test, a photomicrograph of the fabric in cross section is taken between courses or crossover points of continuous filaments and is examined to determine whether the filaments have a spaced-apart relationship to permit effective interpenetration of the individual continuous filaments by the short staple fibers. As in Test D above, the samples are handles in accordance with the type of ordered cross-directional array present, as follows:

(E-1) Samples Having a Knit Construction of Continuous Filament Bundles

A cross section of the fabric sample is prepared for examination by transmitted light under the microscope by embedding the sample in a clear epoxy resin which sets up to a hard block, rough-cutting the block with a razor blade in a direction essentially perpendicular to the wale direction, placing the roughcut block in a microtome, and sectioning it across the wale direction with a steel knife into wafers approximately 8 microns thick. A wafer is selected in which the cross sections of the continuous filament bundles (yarns) are primarily located between courses of the fabric sample, e.g., along line 60 *m* of FIG. 27, the continuous filaments being cut predominantly across their filament axes to give transverse cross sections, rather than along the lengths of the filaments. The wafer is then placed on a microscope slide and immersed in oil having approximately the same index of refraction as the epoxy resin. A photomicrograph of the fabric in cross section is taken at about 44× magnification and, while the wafer is held for further observation, a representative filament bundle is selected for higher magnification. If necessary, more than one wafer is examined to select a representative filament bundle cross section. The microscope is then adjusted for higher magnification of the representative filament bundle cross section such that a photomicrograph can be prepared in which a 2.54 cm×2.54 cm (1 in×1 in) square containing the transverse cross sections of at least four continuous filaments can be inscribed substantially within the periphery of the representative filament bundle cross section; typically, a magnification of 200× can be used. A record is made of the magnification M actually used.

The photomicrograph so prepared is examined under a magnifier having a base with a square opening measuring 2.54 cm (1 inch) on each side, and having a 6× magnification viewing glass mounted about 4 cm above the square opening ("linen tester" magnifier, Edmund Scientific Company, catalog No. 3875, item No. 40030). The square opening of the magnifier is set down upon the area of the photomicrograph which appears to contain the densest concentration of continuous filament transverse cross sections, i.e., the densest observed area of the bundle. The number of continuous filament transverse cross sections (including any fractional area of cross section) within the square opening is counted, ignoring any elongated cross sections from fibers or filaments intercepted which lie at a considerable angle (i.e., more than about 30°) to the wale direction.

Figure 30:
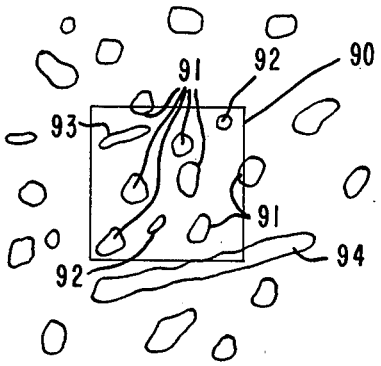

FIG. 30 is a schematic illustration of the manner of carrying out the test for determining %A, defined below, to provide a measure of the spaced-apart relationship of the continuous filaments. The square 90, which measures 2.54 cm on each side, is inscribed upon a photomicrograph of the fabric sample in cross section between courses of the fabric sample within the periphery of a representative filament bundle cross section and represents the area within the continuous filament bundle containing the densest concentration of continuous filament transverse cross sections which is being viewed within the square opening of the magnifier. Transverse cross sections 91 of the continuous filaments, including fractional areas thereof, are counted; and the number of continuous filament transverse cross sections is designated at $T_f$. Transverse cross sections 92 of the staple fibers, which are of smaller area than the continuous filaments in this sample, are not counted. Elongated cross sections 93 and 94 of continuous filaments and staple fibers, respectively, which lie at a considerable angle to the wale direction are also ignored in making this count.

If the continuous filament cross sections can be distinguished from the staple fiber cross sections (as, for example, if they are of different linear density or cross sectional shape), then only the continuous filament transverse cross sections are counted in arriving at the value for $T_f$. If the staple fiber cross sections cannot be distinguished from the filament cross sections, all of the transverse cross sections are counted and the number of continuous filament transverse cross sections is calculated in accordance with the following equation:

$$T_f = T_t + \frac{W_f}{W_f + \frac{W_s}{3}} \qquad \text{Equation (III)}$$

where $T_f$ is the number of continuous filament transverse cross sections, $T_t$ is the total number of transverse cross sections counted, $W_f$ is the weight percent of filament yarns in the sample, and $W_s$ is the weight percent of staple fibers in the sample; it being expected that about one-third of the staple fibers would lie in a direction sufficiently close to the wale direction that their cross sections would be counted as transverse cross sections. The density of the continuous filaments (in g/cm$^3$) and their linear density (in tex) is determined, if not already known. The density of the continuous filaments can be determined from a short segment of filament by the density gradient technique designated as Method "A" by G. Oster and M. Yamamoto, described on pages 260 and 261 of Chemical Reviews, Vol. 63, No. 3, June 1963; while the linear density can be determined in conventional manner by weighing a segment of known length on a sensitive balance. The percentage of the area 90 within the interior of the continuous filament bundle in the region of the densest concentration of continuous filament transverse cross sections which is actually occupied by the sum of the areas of these continuous filament transverse cross sections is designated as %A. The examined area 90 of the interior of the bundle, in $cm^2$, is given by the quantity $(2.54/M)^2$; and the area of each continuous filament transverse cross section is given by the quantity $L/(10^5 \times D)$, where L is the linear density of the continuous filaments in tex and D is the density of the continuous filaments in $g/cm^3$. M is defined at the end of the first paragraph of Test E-1. The value for %A, which is taken as a measure of the spaced-apart relationship of the filaments, is calculated in accordance with the following equation:

$$\% A = \frac{T_f \times L}{10^5 \times D \times \left(\frac{2.54}{M}\right)^2} \times 100\% \qquad \text{Equation (IV)}$$

In accordance with this test, filaments are considered to have an acceptable spaced-apart relationship if %A, as calculated by Equation IV, is less than 30%. At the lower limit, values for this parameter down to about 10% may sometimes be seen.

(E-2) Samples Having a Woven Construction of Continuous Filament Bundles

A cross section of the fabric sample is prepared for examination in the same manner described in Test E-1 above, the wafers being cut essentially perpendicular to the direction in which the filament bundles have the highest degree of spreading as determined in Test D-2. The wafers are cut midway between and essentially parallel to adjacent continuous filament bundles (yarns) in a row of unit cells in the woven fabric, e.g. along line 70 m of FIG. 28. As in Test E-1 above, a photomicrograph of the fabric in cross section is first taken at about 44× magnification and a representative filament bundle near the center of one of the sides of one of the unit cells is selected for higher magnification. The remainder of the test is carried out in the same manner as Test E-1.

(E-3) Samples Having Cross Warps of Continuous Filaments

A cross section of the fabric sample is prepared essentially in the same manner employed in Test E-1 above. Before making the wafers, the fabric sample is first examined in accordance with Test Description D-3 to determine the direction in which the filaments have the highest degree of spreading. The wafers are cut essentially perpendicular to the direction in which filaments have the highest degree of spreading and essentially parallel to the continuous filaments running in the other direction. If the filaments are divided in at least one direction into groups of filaments with intervening spaces and the filaments in the other direction are well spread, the wafers are cut in such a manner as to expose the transverse cross sections of the cut filaments essentially midway between groups of filaments, e.g. along line 80 m of FIG. 29. A representative group of continuous filament transverse cross sections is then selected for higher magnification and the remainder of the test is carried out with respect to this representative group in the same manner as Test E-1.

F. Fiber Loss Test

The fiber loss test is a measure of the degree to which a fabric suffers deterioration in its initial laundering through separation of fibers from the fabric. The test sample is a 2×1.25 cm rectangular swatch, cut from the fabric on the bias and weighed to the nearest 0.0001 g. If it is known or suspected that the original fabric contains water-soluble materials, the fabric is rinsed gently to remove them and then dried in an 80° C. air oven for two hours before the rectangular swatch is cut.

The equipment comprises a 1-liter glass beaker provided with a magnetic stirrer ("Thermolyne" magnetic stirrer, Sybron Corporation, Dubuque, Iowa), using a stirring bar 4.8 cm long and 1 cm in diameter. The fabric sample is placed in the container together with the stirring bar and 300 ml of a 1.7 g/l solution of a synthetic detergent for home laundry use ("Tide", marketed by Procter & Gamble Distributing Company). A wooden ruler 3.5 cm wide and 0.3 cm in thickness is submerged to a distance of 2.54 cm in the center of the bath to act as a baffle to increase turbulence. The magnetic stirrer is turned on and the sample is stirred in the solution for one hour with the stirring bar rotating at 1800 revolutions per minute. The sample is removed, the aqueous detergent solution is discarded, and the sample is then placed back in the container with 800 ml of distilled water. The sample is stirred again at the same speed for three minutes as a rinse, after which it is removed from the container and dried in an 80° C. air oven for two hours. The sample is then weighed again, and the percentage weight loss is calculated and reported as the test result.

G. Edge Strength Test

This test is a measure of the ability of a fabric to maintain its integrity when a hook penetrating very close to the edge of the fabric is pulled in the direction of that edge. The test sample is a 2×1.25 cm rectangular swatch, cut from the fabric on the bias. One of the 1.25-cm edges of the fabric is mounted in a clamp of the same width. Using a microscope with a calibrated reticle, a mark is made at a distance of 0.29 cm from the other 1.25 cm edge of the fabric at about its midpoint. A latched knitting needle (straight blade wire butt; 12 gauge hook and 12 gauge needle) is then inserted into the fabric at the marked point, hooking the entire fabric thickness. The clamp is then mounted in the cell of a tensile testing machine (Table Model Instron, manufactured by the Instron Engineering Corporation, Canton, Mass.), with the knitting needle being clamped in the bottom clamp of the tensile testing machine. The bottom clamp of the machine is then lowered at the rate of 2.54 cm/min. As it is lowered, the force builds up until the knitting needle breaks through the entire thickness of the fabric from the measured mark to the bottom of the fabric. The maximum force (in newtons) required to break the fabric in this way is recorded.

H. Loop Snag Test

The loop snag resistance test, a variation of the Edge Strength Test, is a measure of the resistance of a knitted type fabric to snag, run, and ravel. In this test, a sample of the knit fabric to be characterized is cut with dimensions 1.25 cm in the course direction and 2 cm in the wale direction. The sample is clamped in a 1.25 cm wide clamp at about the midpoint of the sample in the wale direction. The edge of the clamp is parallel to the course direction and between courses. A small crochet hook (no. 13 Boye) is then completely hooked into a single loop at the midpoint in the second row of courses below the clamp. The clamp is then mounted in the cell of the tensile testing machine as in the Edge Strength Test, with the crochet hook being clamped in the bottom clamp of the machine. The bottom clamp of the machine is then lowered at a rate of 2.54 cm/min. As the bottom clamp is lowered, the force builds up and then reduces to zero because the loop breaks or completely ravels or runs. The maximum force achieved (in newtons) and the distance (in cm) the bottom clamp moved when the force went to zero are recorded.

The maximum force is a measure of the resistance afforded by the fabric towards permitting a snagged loop to break, cause a run, or ravel; whereas the distance the bottom clamp moved is a measure of the length of the snag.

When loops are snagged in certain kinds of knitted fabrics, such as conventional Jersey knits, the fabrics may be permanently distorted; or if the loop breaks a hole is left, which allows the fabric to run or ravel. However, knitted fabrics of the invention that have been modified by interlocking short staple fibers into them by hydraulic needling are characterized by resistance to permanent distortion and from running or raveling if a loop is snagged and broken.

I. Contact Cover

The contact covering power of a fabric is determined by calculating the ratio of the difference in the reflectance of the fabric when it is placed in turn against white and gray standard backgrounds, as compared to the difference in the reflectance of the standard backgrounds, and expressing the ratio as a percentage value. The equipment employed in this test comprises a photoelectric reflection meter, a search unit, a green tristimulus filter, a white enamel working standard which is calibrated and has 70–75% reflectance with the green tristimulus filter, and a gray enamel working standard which is calibrated and has 0–10% reflectance with the green tristimulus filter (specific units of such equipment being obtainable from Photovolt Corporation, 95 Madison Ave., New York as Model 610, Model 610-Y, Catalog No. 6130, Catalog No. 6162, and Catalog No. 6163, respectively; or equivalent equipment). Five specimens of the fabric measuring at least 38.1×38.1 mm (1.5×1.5 in.) are required, no two specimens containing the same warp or filling yarns or being taken nearer to the selvedge than 10% of the width of the fabric. The specimens may be tested without cutting, providing that they conform to these specifications. Before testing, the fabric or specimens thereof are conditioned at 21°±1° C. (70°±2° F.) at 65±2% relative humidity for a minimum of 16 hrs.

Before carrying out the test, the reflection meter is adjusted and calibrated in accordance with procedures provided by the manufacturer. To begin the test, the search unit is placed on the white working standard and its reflectance is measured and recorded as $R_{wb}$. The reflectance of the gray working standard is then measured and recorded as $R_{gb}$. A single thickness of the fabric specimen is then placed over the white working standard, the search unit is set on top of the specimen and carefully centered upon it, and the reflectance of the specimen is then measured and recorded as $R_{fwb}$. The procedure is then repeated with the same specimen placed on top of the gray working standard, and the reflectance is measured and recorded as $R_{fgb}$. The test is repeated for each fabric specimen in turn. The contact covering power, % ($I_R$), is then determined for each fabric specimen in accordance with the equation:

$$\%\,(I_R) = \frac{(R_{wb} - R_{gb}) - (R_{fwb} - R_{fgb})}{R_{wb} - R_{gb}} \times 100\% \qquad \text{Equation (V)}$$

The results for contact covering power for each individual sample are calculated to the nearest 0.1%, and these results are then averaged and reported as the final result for the fabric.

EXAMPLE 1

An 18-cut jersey scrim tubing was knitted from 34-filament, 16.7 tex (150-denier) false twist set-textured polyethylene terephthalate filament yarn on a 66 cm (26 in) circular knitting machine at maximum input feed of 716 cm (282 in) per revolution. The tubing was slit open and the resulting knitted scrim fabric, which had a width of 147 cm (58 in), was heat set on a pin tenter frame (manufactured by H. Krantz Appreturmaschinen-Fabrik, Aachen, Germany) at 140° C. with 8% overfeed in both the course and wale directions, resulting in an increase in basis weight from 67.8 to 79.7 g/m$^2$ (2.0 to 2.35 oz/yd$^2$) with a concomitant bulking or blooming of the yarns, especially in the wale direction. The overfeed rates were determined by measurement of the initial and final dimensions of a square drawn with an indelible marker on the fabric before tension was applied. Rolls of this fabric, edge trimmed to a width of 130 cm (51 in) on the tenter frame, were rewound to position the course side of the fabric down, e.g., towards the core of the roll.

The heat-set knitted scrim fabric was fed from the rolls to a 142-cm (56 in) two-stage continuous hydraulic needling machine equipped with four high pressure jets on the first stage needling belt, constructed of 37.8/cm×39.4/cm semi-twill wire screen (96/in×100-/in screen), and three high pressure jets on the drum section, also clothed with semi-twill wire of the same mesh. All jets were provided with jet strips having a single row of 127 μm (5 mil) holes spaced 15.75 holes per cm (40 holes per in). The unit also included a feed belt upon which the roll of knit scrim rested to provide surface driven unwind, a power driven unwind stand for supplying staple paper overlay on top of the scrim, squeeze rolls to remove excess water after second stage needling on the drum, a flowthrough hot air dryer maintained at 93° C., and a windup. The needling machine is shown schematically in FIG. 1.

Throughout the process, as the heat-set knitted scrim fabric was laid continuously upon the first stage needling belt (course side up), staple paper having a width of 102 cm (42 in) was overlaid upon the fabric prior to the entrance to the jet section. The staple paper, manufactured from 0.167 tex (1.5 dpf) 0.64 cm (0.25 in) cut length polyester staple fiber with 10% by wt of highly beaten wood pulp binder, had a basis weight of 27 g/m$^2$ (0.8 oz/yd$^2$) including binder. By gravimetric analysis it was determined that essentially all of the binder was washed from the paper during the subsequent needling step.

The four jets on the first stage needling belt were operated at 6895, 13790, 13790, and 13790 kPa (1000, 2000, 2000 and 2000 psi), and the three drum needler jets at 6895, 13790 and 13790 kPa (1000, 2000 and 2000 psi). All jets were operated at a jet height above the screens of 2.54 cm (1.0 in). After processing through the unit the first time (two side needling), the fabric was wound on rolls and the rolls were then returned to the feed belt and the fabric was reprocessed at the same jet profile on the belt washer—but with the drum jets turned off—so that the complete process provided three side needling of the fabric.

The speeds of the various elements of the unit were set to avoid wrinkling and provide good quality rolls of semi-finished product, and these speeds were measured and found to be as follows:

| | Speed - mpm (ypm) |
|---|---|
| feed belt | 14.0 (15.3) |
| belt needler | 14.4 (15.8) |
| drum needler | 14.4 (15.8) |
| squeeze rolls | 14.6 (16.0) |
| windup | 15.1 (16.5) |

Figure 4:
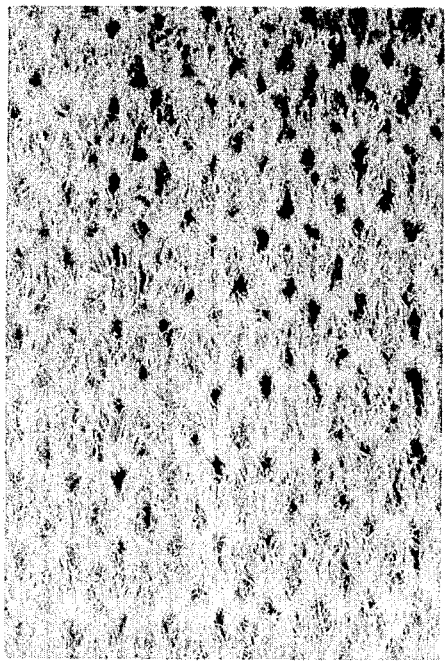
FIGS. 4–5 are photomicrographs at 10× magnification of fabrics made according to Example 1.

These speeds resulted in an 8% increase in the length of the finished fabric and a corresponding loss in width of the fabric. Properties of the fabric, a portion of which is shown in FIG. 4, are shown in Table I.

Figure 5:
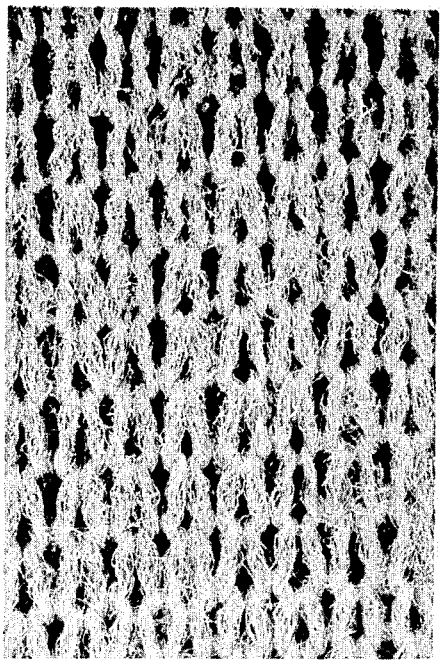
Figure 6:
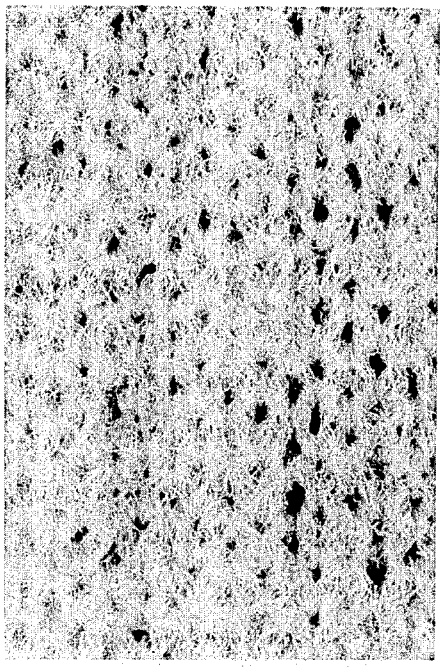
FIGS. 6–16 are photomicrographs at 10× magnification of fabrics made according to Example 2.
Figure 7:
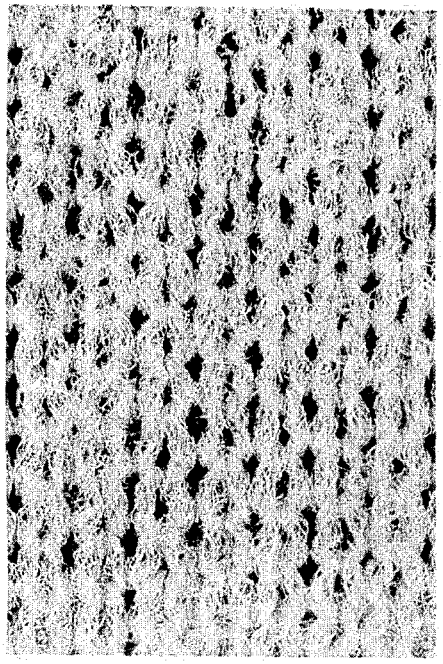
Figure 8:
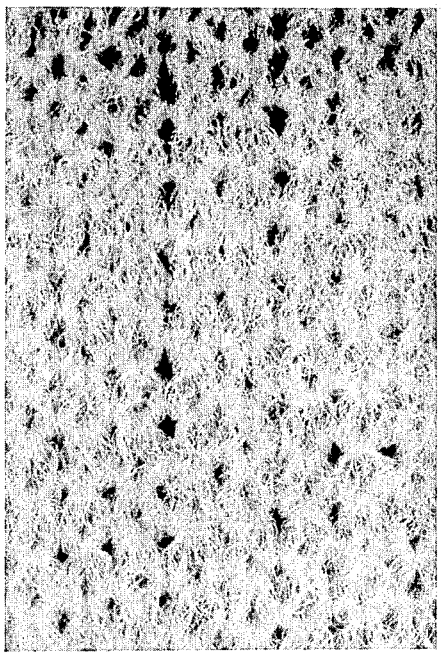
Figure 9:
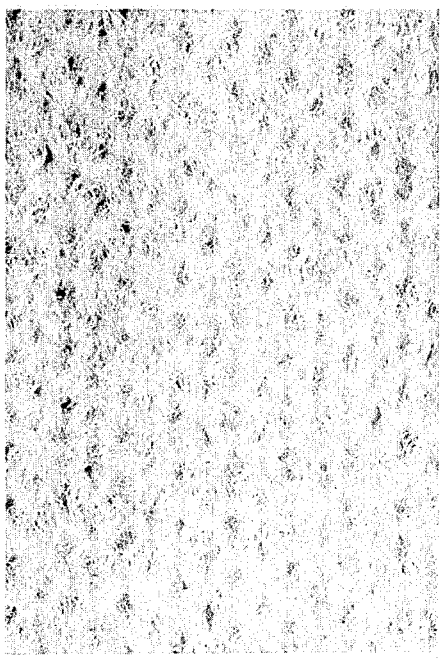
Figure 10:
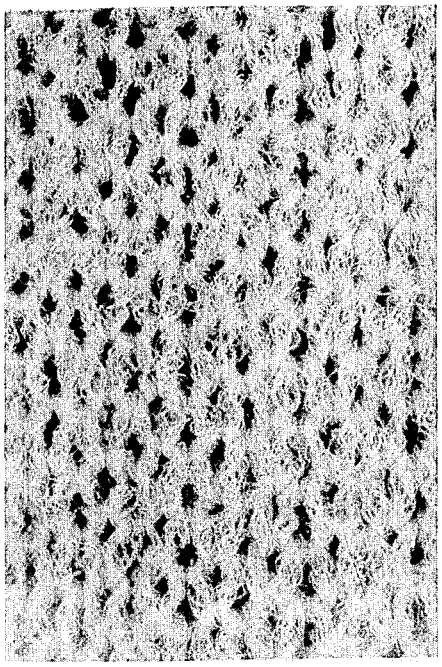
Figure 11:
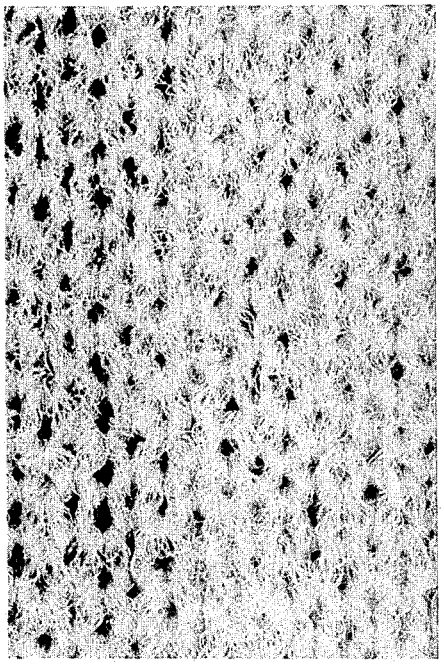
Figure 12:
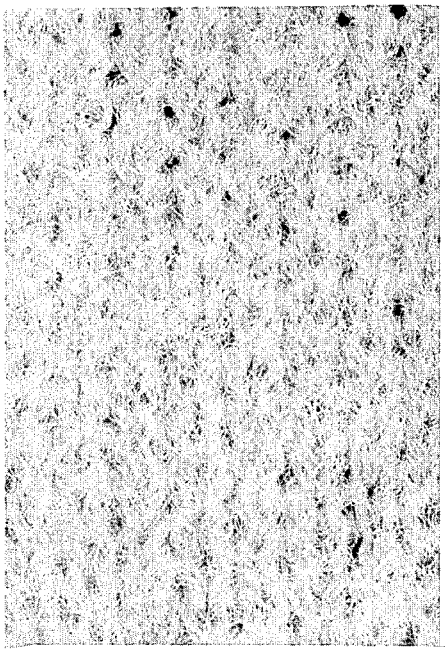
Figure 13:
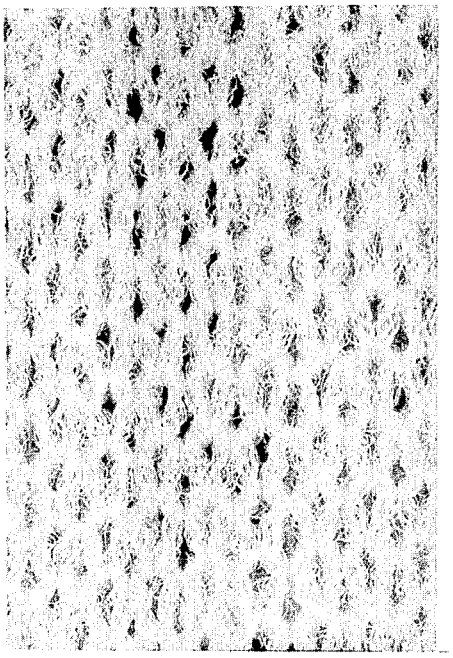
Figure 14:
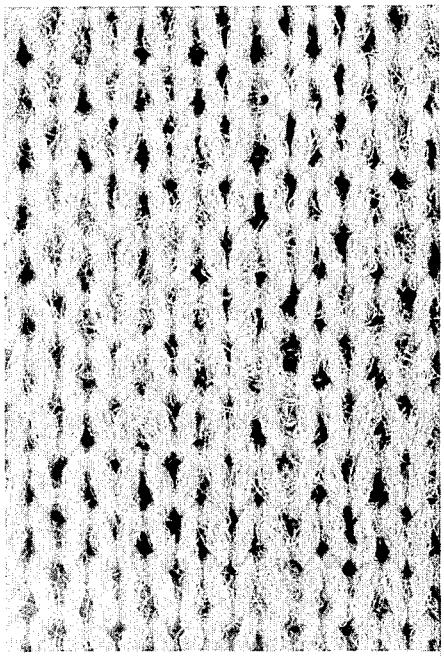
Figure 15:
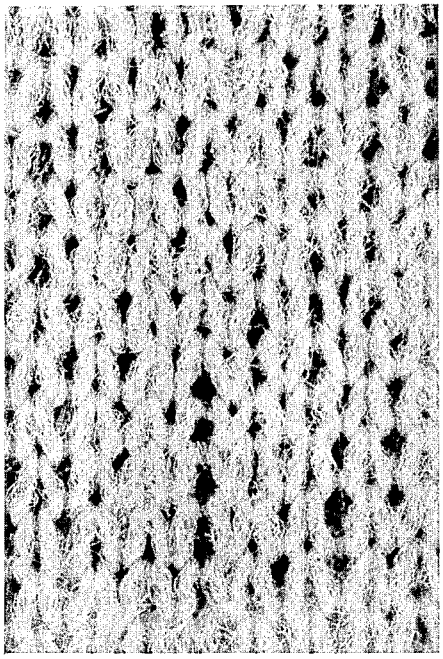
Figure 16:
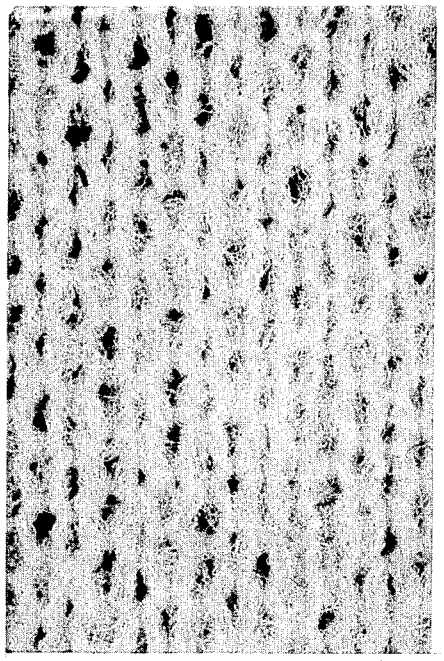

Panels of the final fabric measuring 56×102 cm (22×40 in) were pot dyed at the boil and heat set at 180° C. to a final size of 60×80 cm (23.5×31.5 in) and a final weight of 56.1 g (1.98 oz). Properties of the dyed and heat-set fabric, a portion of which is shown in FIG. 5, are shown in Table I.

EXAMPLE 2

In a series of experiments for which the process conditions employed are listed in Table II, fabrics of FIGS. 6–16 were made by interlocking short staple fibers into knitted scrim fabrics of false-twist set-textured continuous filament polyester yarns. The properties and characteristics of the product fabrics are reported in Table I along with the corresponding Example 1 data. The starting material fabric of FIGS. 6–12 was the same heat-set knitted scrim fabric employed as the starting material in Example 1, the preparation of which is described in the first paragraph thereof. Similar knitted scrim fabrics were employed as starting materials to make the remaining samples listed in Tables I and II. In each case an 18-cut jersey scrim tubing was knitted from a 16.7 tex (150-denier) false twist set-textured polyethylene terephthalate filament yarn and the tubing was slit open and heat-set as in Example 1. The number of filaments in the yarn and the scrim heat-setting temperature are listed in Table II.

To make the fabrics of FIGS. 6–16 rectangular panels of the heat-set knit scrim fabric measuring approximately 100 cm (39.4 in) in the wale direction and 50 cm (19.7 in) in the course direction were placed course side up on a 37.8/cm×39.4/cm semi-twill wire screen (96/in×100/in screen) of a needling machine, with the long dimension of the panel in the machine direction. In each experiment, the knit scrim panel was overlaid with one or two sheets (as indicated in Table II) of staple paper having about the same dimensions as the panel, any curled edges of the panel being smoothed and narrow brass bars being placed along each edge of the paper so that the scrim and the overlying paper lay flat. The sandwich of scrim and paper was then wet down with water. The staple paper employed was made of 0.64 cm (0.25 in) cut length polyester staple fibers containing polyvinyl alcohol as a binder. The sandwich was then hydraulically needled for the number of cycles indicted in the table, with the indicated needling conditions during each pass, from a row of 127 mμ (5 mil) holes spaced 15.75 holes per cm (40 holes per in) and located at a distance of 1.9 cm (0.75 in) above the staple paper. At the conclusion of each cycle, the fabric sample was turned over so that it would be hydraulically needled from the side opposite to the side needled during the previous cycle. At the conclusion of the needling operation, the fabrics were boiled off and heat-set.

EXAMPLE 3

In a series of experiments for which the process conditions employed are listed in Table III, fabrics, portions of which are shown in FIGS. 17–20, were made by interlocking short staple fibers into woven scrim fabrics of false-twist textured continuous filament polyester yarns. The properties and characteristics of the product fabrics are reported in Table IV. The scrim fabrics were woven in each case from 34-filament, 16.7 tex (150-denier) false twist textured polyethylene terephthalate filament yarn. The scrim fabric of FIG. 17 was woven from a sized warp of 12.6 ends/cm (32 ends/in) at a pick count of 3.1 ends/cm (8 ends/in.). The shuttle of the loom carrying the same yarn was passed back and forth four times between each closing and opening of the shed. Selvedges were woven at each edge at each passage of the shuttle to stabilize the filling yarns and permit winding on the loom without distortion. The construction of each of the scrims employed is listed in Table III. Unsized yarn was employed to make the scrims for the fabric of FIGS. 18–20.

Figure 17:
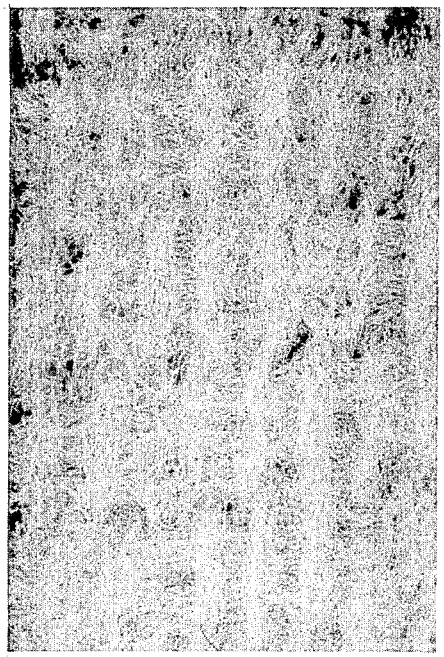
FIGS. 17–20 are photomicrographs at 10× magnification of fabrics made according to Example 3.
Figure 18:
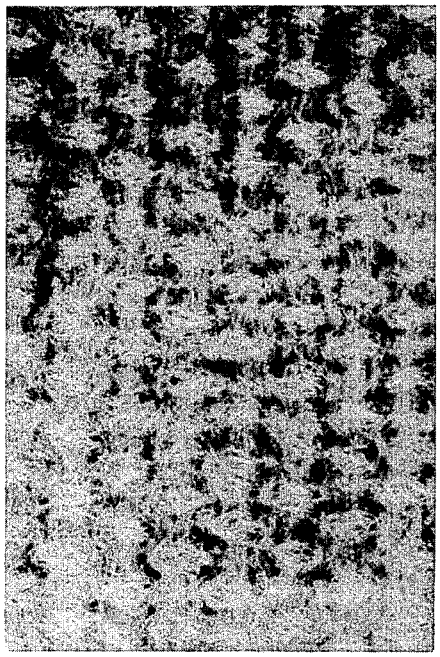
Figure 19:
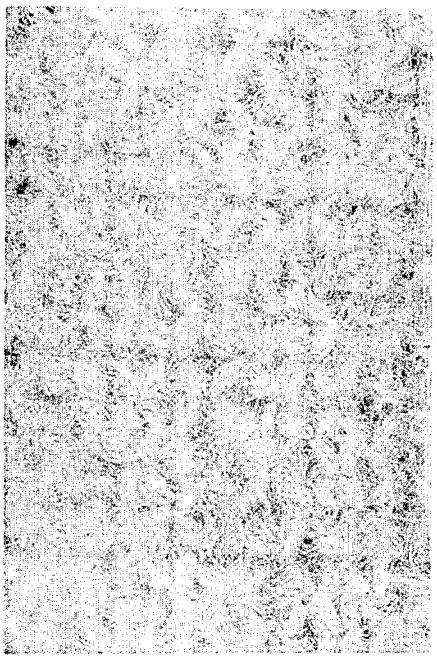
Figure 20:
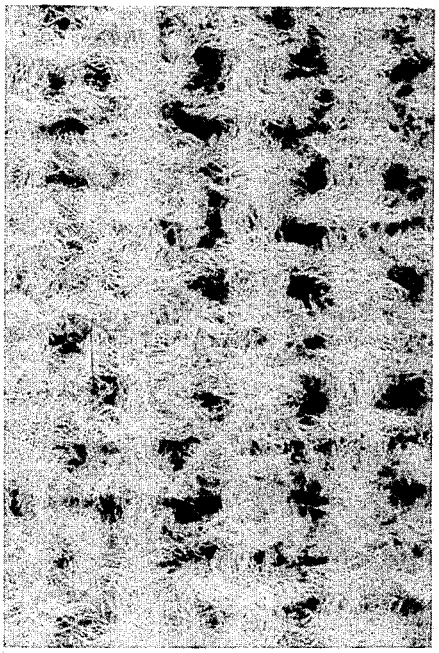
Figure 21:
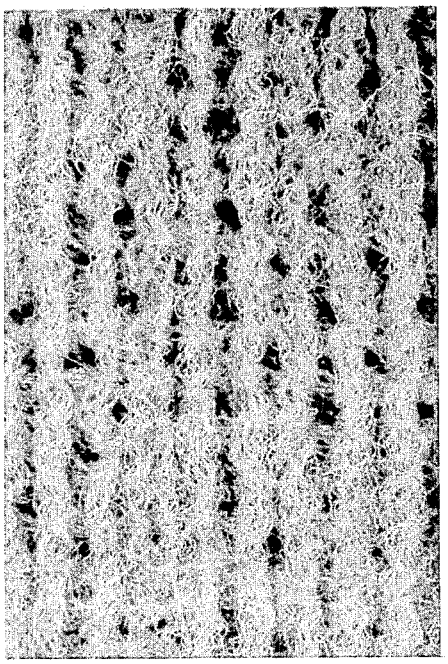
FIGS. 21–25 and **21*a*–25*a*** are photomicrographs at 10× magnification, face and back portions, respectively, of the fabrics made according to Example 4.
Figure 21A:
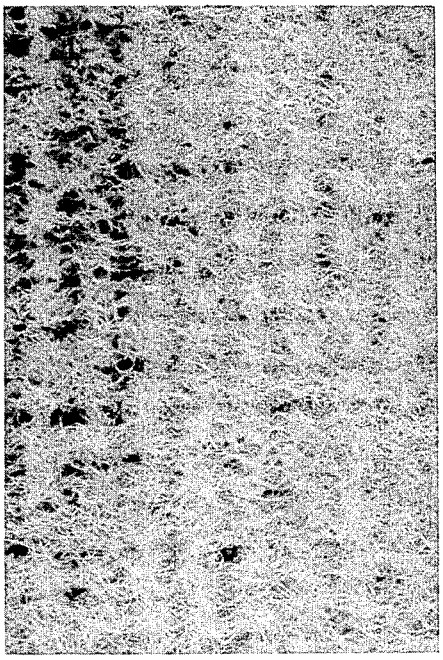
Figure 22:
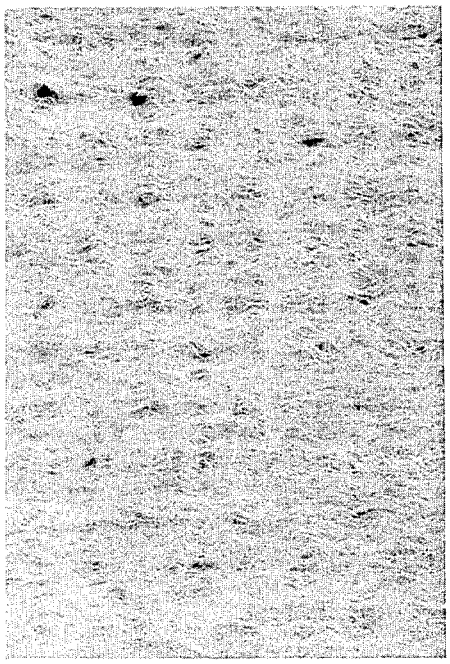
Figure 22A:
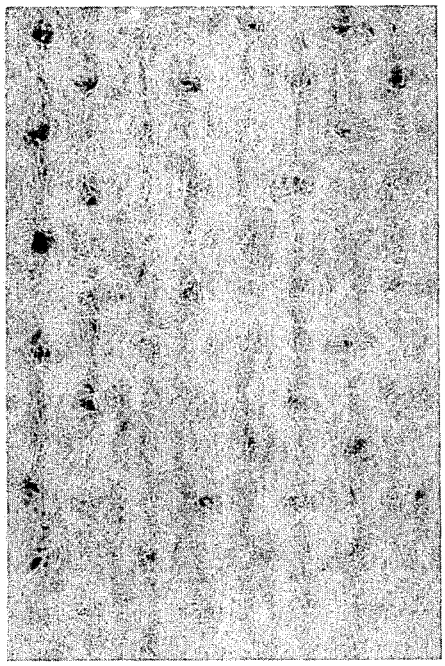
Figure 23:
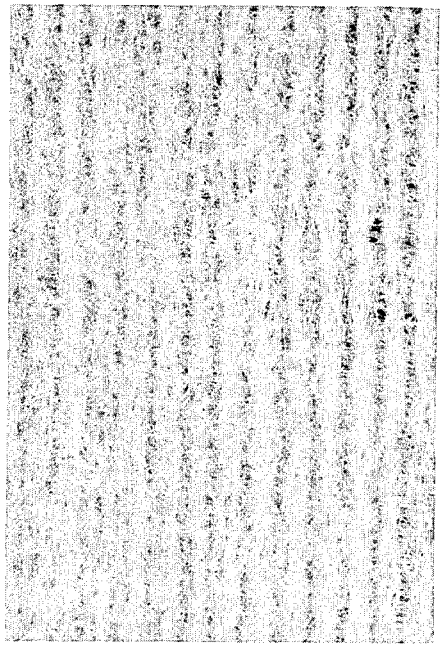
Figure 23A:
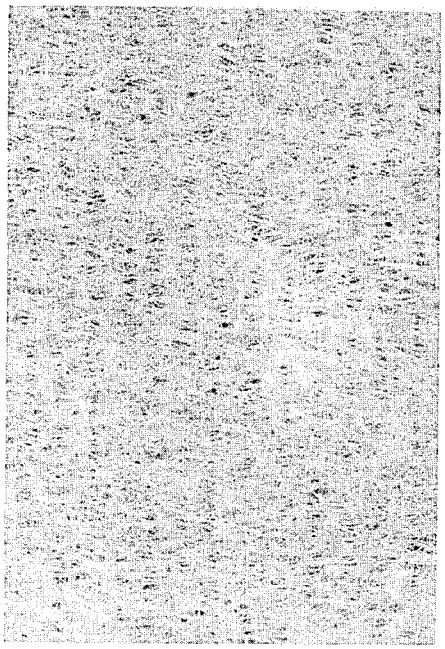
Figure 24:
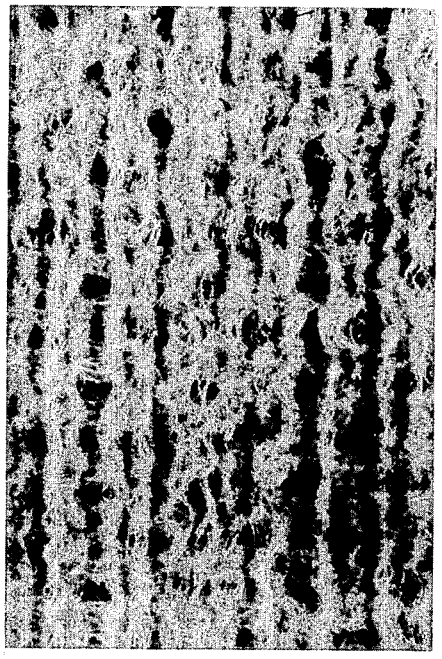
Figure 24A:
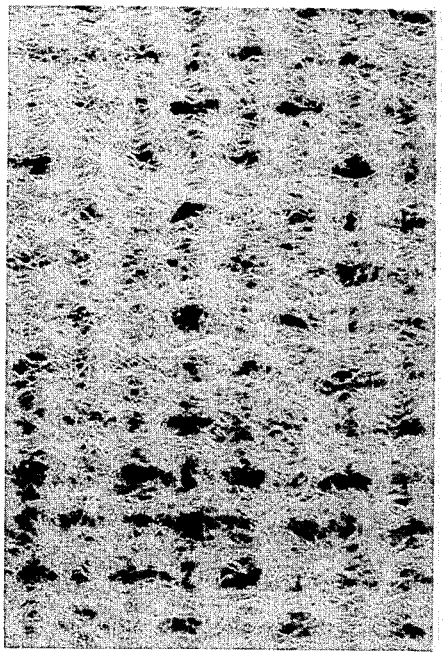
Figure 25:
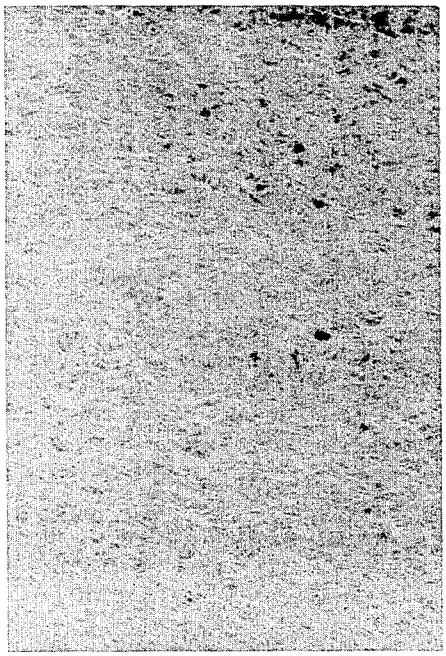
Figure 25A:
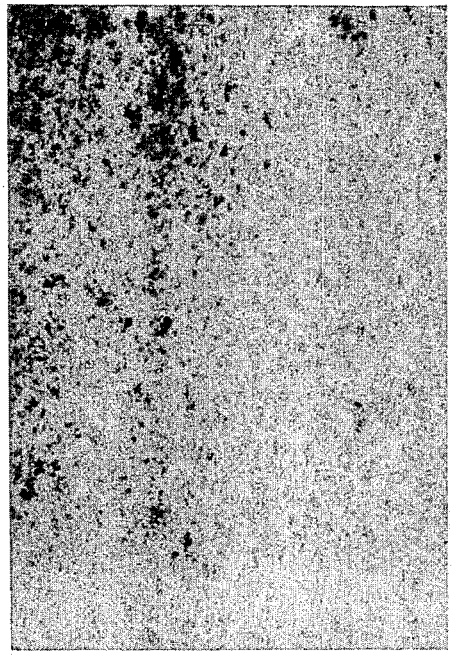

To make the fabrics of FIGS. 17–20, rectangular panels of the woven scrim fabric were cut out, placed on the needling machine, overlaid with one or two sheets (as indicated in Table III) of staple paper having about the same dimensions as the panel, and hydraulically needled in accordance with the procedure already described in Example 2 with respect to the knit scrim fabrics of that example. The staple paper used was the same paper used in Example 2. In the case of FIG. 17, the fabric was given a preliminary treatment to remove size from the warp yarns, in which the rectangular panel was first covered with a nylon monofil fabric having a 39.4/cm×39.4/cm weave (100/in×100/in) and a hot 1% solution of a detergent was poured over the surface of the cover fabric, causing the scrim to shrink about 5% in length and 10% in width with accompanying increase in yarn spreading. Before overlaying this sample with paper, it was given a light hydraulic needling to further increase yarn spreading by passing it twice at a pressure of 3447 kPa (500 psi) and twice again under a pressure of 6895 kPa. (1000 psi). At the conclusion of the needling operation, each of the fabrics was boiled off and heat-set.

EXAMPLE 4

Cross warps of 34-filament, 16.7-tex (150-denier) false twist textured continuous filament yarns of polyethylene terephthalate were taped under tension on metallic frames having an interior rectangular space measuring about 96 cm×55 cm, with the exterior dimensions about 4 cm greater in each direction. To form the cross warp, the frame was first clamped along one side of a bar of 5 cm×5 cm (2 in×2 in) square cross section mounted for axial rotation on a lathe, with the long sides of the frames parallel to the bar and equally spaced from it. In most cases, for better utilization of the yarn, two frames were mounted on opposite sides of the bar for simultaneous winding. The long sides of the frame were then covered with tape having adhesive on both sides and the yarn was continously wound across the face of the frame to form, as the lathe advanced, a warp upon each frame having the desired spacing. The winding tension is about 0.3 gpd, and on each turn the yarn passes to the rear of the bar between passages across the face of the frame (across the face of the other frame when two frames were used). When the frame was fully wound, the sides of the frame were taped again over the yarn to hold the warp in place, and the ends of yarn along the exterior of the frame were cut. The frame was then removed and clamped again on the bar with the short sides of the frame parallel to the bar and equally spaced from it. The short sides were then covered with doubly-faced adhesive tape, the yarn was continuously wound across the face of the frame to form a warp in the cross direction having the desired spacing, the edges of the frame were then taped again to hold the cross warp in place, and the frame was cut free by cutting the yarns along the edges of the frame.

In a series of experiments for which the process conditions are summarized in Table V fabrics, portions of which are shown in FIGS. 21–25 (face) and in FIGS. *21a–25a* (back), were made by interlocking short staple fibers into cross-warps prepared as described above. The frames were placed on a 37.8/cm×39.4/cm mesh semi-twill screen. One or more sheets (as indicated in Table V) of staple paper having the basis weight indicated in the Table were placed on top of the cross warp. Both papers were made from 0.64 cm (0.25 in) cut length polyester staple fibers. The assembly was placed on a belt and was hydraulically needled for the number of cycles indicated in the table, with the indicated needling conditions during each pass, from a row of 127 mμ holes spaced 15.75 holes per cm and located at the indicated distance above the staple paper. At the conclusion of each cycle, the fabric sample was turned over so that it would be hydraulically needled from the side opposite the side needled during the previous cycle. At the conclusion of the needling operation, the fabrics were boiled off and heat set. The properties and characteristics of the product fabrics are reported in Table VI.

EXAMPLE 5

Figure 26:
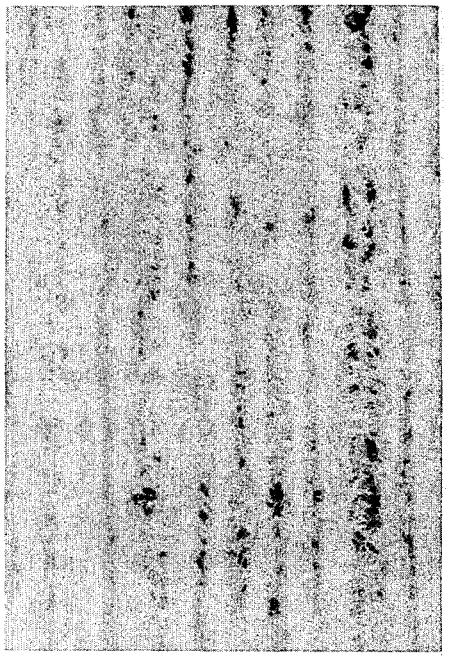
Figure 26A:
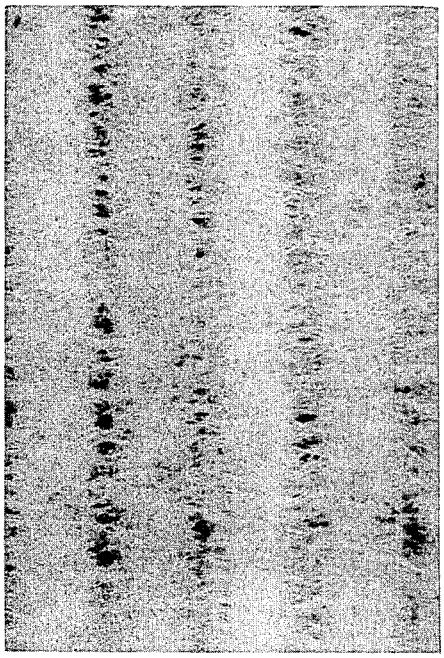

Cross warps of 34-filament, 16.7-tex (150-denier) false twist textured continuous filament yarns of polyethylene terephthalate were taped under tension on metallic frames as in Example 4. The warp in the machine direction was laid down as single ends of yarn at a spacing of 16 ends per cm under a tension of 90 g., while the warp in the cross direction was laid down in sets of four ends of yarn together at a spacing of 4 ends per cm under a tension of 50 g. The frame having the cross warp mounted upon it was laid on the semi-twill screen as in Ex. 4 and three sheets of staple paper were placed on top of the cross-warp. The staple paper had a basis weight of 27.1 g/m$^2$ (0.8 oz./yd.$^2$) and was formed of 85% by weight polyethylene terephthalate staple fibers of 0.167 tex (1.5 denier) having a cut length of 6.35 mm (0.25 in.) and 15% by weight of a binder (which was washed out in the subsequent hydraulic needling) comprising equal parts of polyvinyl alcohol and glass microfibers. The assembly was placed on a belt and was hydraulically needled by passing it at a speed of 13.7 mpm (15 ypm) under streams of water from a row of 127 mμ holes spaced 15.75 holes per cm and located 38.1 mm above the staple paper, the assembly being passed under the streams first in one direction and then in the reverse direction. During the first six passes the streams of water were supplied at a pressure of 3448 KPa (500 psi), after which the assembly was needled at 10343 KPa (1500 psi) for four more passes. The assembly was turned over and needled at 6895 KPa (1000 psi) for four passes, then turned over again and needled for eight passes at a pressure of 11032 KPa (1600 psi). The panel of fabric so formed was then cut in half and placed back on the screen in a direction perpendicular to its previous direction (with the warp formed from four ends of yarn laid down together now lying in the machine direction). A patterning plate consisting of a group of bars, each having a height of 2.3 mm (0.09 in), a width at the base of 1.65 mm (0.065 in), and a somewhat rounded top having a width of 0.8 mm (0.0315 in) with a spacing of 5 bars per cm was then placed on top of the fabric, with the bars lying in the machine direction of the fabric. The assembly was then needled at 10687 KPa (1550 psi) for two more passes at a belt speed of 9.12 mpm and the holes 50.8 mm above the fabric. Needling the fabric through the patterning plate caused the warp yarns originally laid down singly at a spacing of 16 ends of yarn per cm to be pushed together into wales having a spacing of 5 wales per cm. The product was heat set for 5 minutes at 180° C. It had a basis weight of 144.1 g/m$^2$ (4.25 oz/yd$^2$) and had the appearance and hand of a conventional corduroy fabric of good quality. A photomicrograph at 10× magnification of the side of the fabric opposite the wales of corduroy pattern revealed that the filaments lying in the direction perpendicular to the wales were very well spread and exhibited a spaced-apart relationship, the degree of filament spreading (%S) being 100% and the test for spaced-apart relationship of filaments (%A) giving a value of 19.5%. The reversal frequency test established that the staple fibers had 3.9 reversals per cm of staple length. The fabric was found to have excellent strength, measuring 26.11 newtons in the edge strength test. In the fiber loss test it was determined that the fabric lost only 1.2% of its fiber content during initial laundering. The fabric had excellent cover, the value for contact cover being 81.8% for the undyed fabric. Portions of the fabric are shown in FIG. 26 (face) and FIG. *26a* (back).

TABLE I

| Fabric Property or Characteristic | Properties and Characteristics Of Fabrics Made From Knitted Scrim Fabrics — Figure No. 4 | 5 | 6 | 7 | 8 | 9 |
|---|---|---|---|---|---|---|
| Basis wt., g/m$^2$ | 100.3 | 101.0 | 113.6 | 98.3 | 106.1 | 131.9 |
| Reversal Freq., revs./cm | 5.1 | 3.8 | 4.5 | 3.5 | 4.6 | 3.3 |
| Degree of filament spreading, %S | 73.3 | 69.3 | 85.1 | 73.2 | 84.7 | 92.2 |
| Test for spaced- | | | | | | |

TABLE I-continued

| | | | | | | |
|---|---|---|---|---|---|---|
| apart relationship of filaments, %A | 17.4 | 17.8 | 19.5 | 15.2 | 22.8 | 21.7 |
| Knit construction density, g/cm$^4$ | 0.90 | 0.85 | 1.10 | 0.91 | 1.07 | 1.33 |
| Fiber Loss, % | 2.4 | 2.2 | 2.9 | 2.8 | 2.4 | 0.84 |
| Edge Strength, newtons | 15.70 | 18.24 | 18.24 | 21.75 | 17.97 | 21.80 |
| Snag Force newtons | 12.8 | 13.0 | 14.4 | 13.0 | 11.4 | 13.1 |
| Snag length, cm. | 0.635 | 0.483 | 0.483 | 0.457 | 0.559 | 0.406 |
| Contact cover, % | 67.5 | 93.7* | 71.9 | 66.5 | 66.9 | 73.9 |

Properties and Characteristics of Fabrics Made From Knitted Scrim Fabrics

| Fabric Property or Characteristic | Figure No. 10 | 11 | 12 | 13 | 14 | 15 | 16 |
|---|---|---|---|---|---|---|---|
| Basis wt., g/m$^2$ | 111.2 | 112.6 | 115.9 | 100.3 | 98.3 | 97.0 | 112.9 |
| Reversal Freq., revs./cm | 2.7 | 3.5 | 4.8 | 2.8 | 3.0 | 2.9 | 4.2 |
| Degree of filament spreading, %S | 74.5 | 75.5 | 72.7 | 77.4 | 68.6 | 67.4 | 67.1 |
| Test for spaced-apart relationship of filaments, %A | 14.1 | 22.8 | 16.9 | 17.4 | 24.4 | 15.2 | 22.8 |
| Knit construction density, g/cm$^4$ | 1.12 | 1.13 | 1.26 | 0.96 | 0.87 | 0.94 | 0.96 |
| Fiber Loss, % | 1.5 | 1.8 | 2.7 | 2.4 | 2.1 | 2.2 | 2.4 |
| Edge Strength, newtons | 15.21 | 18.46 | 17.30 | 16.99 | 19.39 | 19.17 | 21.04 |
| Snag force, newtons | 11.7 | 13.4 | 12.2 | 11.5 | 12.5 | 12.9 | 12.8 |
| Snag length, cm. | 0.533 | 0.483 | 0.457 | 0.610 | 0.457 | 0.483 | 0.457 |
| Contact cover, % | 70.1 | 69.5 | 71.9 | 68.5 | 73.6* | 71.3* | 73.0 |

*Fabric dyed yellow
*Fabric dyed blue

TABLE II

Process Conditions Employed in Making Fabrics From Knitted Scrim Fabrics of Example 2

| Starting Material or Process Step | | Figure No. 6 | 7 | 8 | 9 | 10 |
|---|---|---|---|---|---|---|
| No. of filaments in yarn | | 34 | 34 | 34 | 34 | 34 |
| Heat-set Temp, °C. | | 140 | 140 | 140 | 140 | 140 |
| No. of sheets of paper | | 1 | 1 | 1 | 2 | 1 |
| Jet pressures, MPa | | | | | | |
| First cycle, pass | 1 | 6.9 | 6.9 | 6.9 | 6.9 | 6.9 |
| | 2 | 13.8 | 13.8 | 13.8 | 13.8 | 13.8 |
| | 3 | 13.8 | 13.8 | 13.8 | 13.8 | 13.8 |
| | 4 | 13.8 | 13.8 | 13.8 | 13.8 | 13.8 |
| | 5 | — | — | — | — | — |
| Second Cycle, pass | 1 | 6.9 | 6.9 | 6.9 | 6.9 | 6.9 |
| | 2 | 13.8 | 13.8 | 13.8 | 13.8 | 13.8 |
| | 3 | 13.8 | 13.8 | 13.8 | 13.8 | 13.8 |
| | 4 | — | — | — | — | 13.8 |
| | 5 | — | — | — | — | — |
| Third Cycle, pass | 1 | 6.9 | 6.9 | 6.9 | 6.9 | — |
| | 2 | 13.8 | 13.8 | 13.8 | 13.8 | — |
| | 3 | 13.8 | 13.8 | 13.8 | 13.8 | — |
| | 4 | 13.8 | 13.8 | 13.8 | 13.8 | — |
| | 5 | — | — | — | — | — |

| Starting Material or Process Step | | Figure No. 11 | 12 | 13 | 14 | 15 | 16 |
|---|---|---|---|---|---|---|---|
| No. of filaments in yarn | | 34 | 34 | 34 | 68 | 68 | 68 |
| Heat-set Temp, °C. | | 140 | 140 | 149 | 140 | 140 | 140 |
| No. of sheets of paper | | 1 | 1 | 1 | 1 | 1 | 2 |
| Jet pressures, MPa | | | | | | | |
| First cycle, pass | 1 | 6.9 | 6.9 | 13.8[c] | 18.3[c] | 8.3[c] | 8.3[c] |
| | 2 | 13.8 | 13.8 | 13.8 | 12.4 | 12.4 | 12.4 |
| | 3 | 13.8 | 13.8 | 13.8 | 12.4 | 12.4 | 12.4 |
| | 4 | 13.8 | 13.8 | 13.8 | 12.4 | 12.4 | 12.4 |
| | 5 | — | — | — | 12.4 | 12.4 | 12.4 |
| Second Cycle, pass | 1 | 6.9 | 6.9 | 6.9 | 8.3[c] | 8.3[c] | 8.3[c] |
| | 2 | 13.8 | 13.8 | 13.8 | 12.4 | 12.4 | 12.4 |
| | 3 | 13.8 | 13.8 | 13.8 | 12.4 | 12.4 | 12.4 |

TABLE II-continued

| Process Conditions Employed in Making Fabrics From Knitted Scrim Fabrics of Example 2 | | | | | | | |
|---|---|---|---|---|---|---|---|
| | 4 | 13.8 | 13.8 | 13.8 | 12.4 | 12.4 | 12.4 |
| | 5 | — | — | 13.8 | 12.4 | 12.4 | 12.4 |
| Third Cycle, pass | 1 | 6.9 | 6.9 | — | 8.3 | 8.3 | 8.3 |
| | 2 | 13.8 | 13.8 | — | 12.4 | 12.4 | 8.3 |
| | 3 | 13.8 | 13.8 | — | 12.4 | 12.4 | 12.4 |
| | 4 | 13.8[a] | 13.8[b] | — | 12.4 | 12.4 | 12.4 |
| | 5 | — | — | — | 12.4 | 12.4 | 12.4 |

Footnotes:
[a]Followed by a fourth cycle identical to the third.
[b]Followed by two more cycles identical to the third.
[c]Fabric rinsed with hot water after this pass.

TABLE III

| Process Conditions Employed In Making Fabrics From Woven Scrim Fabrics | | | | | |
|---|---|---|---|---|---|
| Starting Material or Process Step | | Figure No. 17 | 18 | 19 | 20 |
| Scrim Construction | | | | | |
| ends/cm in warp | | 12.6 | 16.5 | 12.6 | 11.8 |
| picks/cm | | 12.6 | 15.8 | 11.8 | 18.9 |
| picks/shed | | 4 | 2 | 1 | 1 |
| No. of sheets of paper | | 2 | 1 | 1 | 1 |
| Jet Height, cm | | 3.8 | 1.9 | 1.9 | 3.8 |
| Jet Pressures, MPa | | | | | |
| First cycle, | pass 1 | 3.5[a] | 6.9 | 2.8 | 2.8 |
| | pass 2 | 6.9 | 13.8 | 5.5 | 5.5 |
| | pass 3 | 8.3[b] | 13.8 | 8.3[b] | 8.3[b] |
| | pass 4 | 8.3 | 13.8 | 12.4 | 12.4 |
| | pass 5 | — | — | 12.4 | 12.4 |
| | pass 6 | — | — | 12.4 | 12.4 |
| Second cycle, | pass 1 | 3.5 | 6.9 | 6.9 | 6.9 |
| | pass 2 | 6.9 | 13.8 | 12.4 | 12.4 |
| | pass 3 | 8.3 | 13.8 | 12.4 | 12.4 |
| | pass 4 | 8.3 | 13.8 | 12.4 | 12.4 |
| | pass 5 | 8.3 | — | — | — |
| | pass 6 | 8.3 | — | — | — |
| Third cycle, | pass 1 | 6.9 | 6.9 | 6.9 | 6.9 |
| | pass 2 | 11.7 | 13.8 | 12.4 | 12.4 |
| | pass 3 | 11.7 | 13.8 | 12.4 | 12.4 |
| | pass 4 | 11.7 | 13.8 | 12.4[c] | 12.4[c] |

TABLE III-continued

| Process Conditions Employed In Making Fabrics From Woven Scrim Fabrics | | | | |
|---|---|---|---|---|
| Starting Material or Process Step | Figure No. 17 | 18 | 19 | 20 |
| pass 5 | 11.7[c] | — | — | — |

Footnotes:
[a]Preliminary treatment described in Ex. 3.
[b]Fabric rinsed with hot water after this pass.
[c]Followed by two more cycles identical to the third.

TABLE IV

| Properties and Characteristics of Fabrics Made From Woven Scrim Fabrics | | | | |
|---|---|---|---|---|
| Fabric Property or Characteristic | Figure No. 17 | 18 | 19 | 20 |
| Basis wt., g/m$^2$ | 123.7 | 106.8 | 101.7 | 106.8 |
| Reversal frequency, revs/cm | 4.1 | 5.0 | 4.9 | 4.5 |
| Degree of filament spreading, % S | 74.5 | 77.1 | 69.1 | 59.4 |
| Test for spaced-apart relationship of filaments, % A | 22.8 | 29.3 | 28.2 | 20.6 |
| Fiber Loss, % | 1.8 | 1.2 | 1.3 | 1.5 |
| Edge strength, newtons | 25.18 | 22.60 | 23.04 | 22.02 |
| Contact cover, % | 75.0 | 73.6 | 93.7* | 70.7 |

*Fabric dyed red

TABLE V

| Process Conditions Employed in Making Fabrics From Cross Warps | | | | |
|---|---|---|---|---|
| Starting Material or Process Step | | Figure No. 21, 21a | 22, 22a | 23,23a |
| Warp Construction | | | | |
| Machine direction: ends/cm × yarns/end | | 15.75 × 2 | 12.6 × 1 | 9.45 × 1 |
| Cross direction: ends/cm × yarns/end | | 3.94 × 4 | 3.15 × 4 | 3.15 × 3 |
| Staple Paper | | | | |
| 14.4 g/m$^2$ basis wt; no of sheets | | 0 | 0 | 1 |
| 27.1 g/m$^2$ basis wt; no of sheets | | 1 | 2 | 1 |
| Jet Height, cm. | | 5.1 | 3.8 | 2.5 |
| Jet Pressures, MPa | | | | |
| First cycle, pass | 1 | 1.4 | 3.5 | 6.9[b] |
| | 2 | 3.5 | 6.9[b] | 6.9[d] |
| | 3 | 5.2 | 12.4 | 8.3 |
| | 4 | 6.9 | 12.4 | 12.4 |
| | 5 | — | 12.4 | 12.4 |
| | 6 | — | 12.4 | 12.4 |
| | 7 | — | — | 12.4 |
| Second cycle, pass | 1 | 3.5 | 6.9 | 6.9 |
| | 2 | 6.9 | 12.4 | 12.4 |
| | 3 | — | 12.4 | 12.4 |
| | 4 | — | 12.4 | 12.4 |
| | 5 | — | 12.4 | 12.4 |
| Third cycle, pass | 1 | 6.9 | 6.9 | 6.9 |
| | 2 | 6.9 | 12.4 | 12.4 |
| | 3 | 6.9 | 12.4 | 12.4 |
| | 4 | 6.9[a] | 12.4 | 12.4 |
| | 5 | — | 12.4[c] | 12.4[e] |

TABLE V-continued

| Process Conditions Employed in Making Fabrics From Cross Warps | | Figure No. | |
|---|---|---|---|
| Starting Material or Process Step | | 24,24a | 25,25a |
| Warp Construction | | | |
| Machine direction: ends/cm × yarns/end | | 9.45 × 1 | 12.6 × 1 |
| Cross direction: ends/cm × yarns/end | | 3.15 × 4 | 3.15 × 4 |
| Staple Paper | | | |
| 14.4 g/m² basis wt; no of sheets | | 1 | 1 |
| 27.1 g/m² basis wt; no of sheets | | 1 | 1 |
| Jet Height, cm. | | 2.5 | 3.8 |
| Jet Pressures, MPa | | | |
| First cycle, pass | 1 | 6.9[b] | 3.5 |
| | 2 | 6.9[d] | 6.9 |
| | 3 | 8.3 | 12.4 |
| | 4 | 12.4 | 12.4 |
| | 5 | 12.4 | 12.4 |
| | 6 | 12.4 | 12.4 |
| | 7 | 12.4 | — |
| Second cycle, pass | 1 | 8.3 | 6.9 |
| | 2 | 12.4 | 12.4 |
| | 3 | 12.4 | 12.4 |
| | 4 | 12.4 | 12.4 |
| | 5 | 12.4 | 12.4 |
| Third cycle, pass | 1 | 8.3 | 6.9 |
| | 2 | 12.4 | 12.4 |
| | 3 | 12.4 | 12.4 |
| | 4 | 12.4 | 12.4 |
| | 5 | 12.4[e] | 12.4[c] |

Footnotes:
a. Followed by two more cycles identical to the third, then a single pass at 2.1 MPa in the sixth cycle.
b. Fabric rinsed with hot water after this pass. c. Followed by one more cycle idential to the third. d. Cut from frame. e. Followed by two more cycles identical to the third.

TABLE VI

| Fabric Property or Characteristic | Properties and Characteristics of Fabrics Made From Cross Warps Figure No. 21,21a | 22,22a | 23,23a | 24,24a | 25,25a |
|---|---|---|---|---|---|
| Basis Wt., g/m² | 105.1 | 120.3 | 86.4 | 100.0 | 94.9 |
| Reversal frequency, revs/cm | 4.8 | 4.3 | 6.5 | 5.0 | 5.4 |
| Degree of filament spreading, % S | 62.3 | 65.1 | 100 | 74.9 | 100 |
| Test for spaced-apart relationship of filaments, % A | 10.6 | 15.2 | 11.9 | 19.5 | 22.8 |
| Fiber Loss, % | 1.24 | 1.40 | 0.9 | 1.3 | 0.92 |
| Edge strength, newtons | 18.19 | 24.73 | 18.15 | 18.82 | 23.35 |
| Contact cover, % | 95.4* | 92.7* | 68.7* | 70.4** | 74.2 |
| Fabric Type | Print Cloth | Flan-nelette | Flan-nelette | Flan-nelette | Pillow Case |

*Fabric dyed blue
**Fabric dyed yellow

I claim:

1. A lightweight composite fabric comprising: a substrate of continuous filaments formed into an ordered cross-directional array, said continuous filaments being well spread and having a spaced-apart relationship throughout the array in at least one direction of the array, said filaments being well spread provided that the average spacing between any bundles of filaments is no larger than the average width of said bundles of filaments, said filaments having a spaced-apart relationship provided that in the densest observed area of the filament bundle cross section the sum of the areas of the filament cross sections occupies less than 30% of the densest observed area of the cross section, said substrate being combined with staple fibers of less than 0.3 tex per filament and from about 0.5 cm to about 1 cm in length in the amount of from 20 to 50% of the weight of the composite fabric, said staple fibers extending through and entangled with said continuous filaments and having more than about 2 reversals in direction between the faces of the fabric per cm of staple fiber length; said composite fabric having an edge strength of from about 15 to 30 newtons and experiencing a loss of no more than 3% of its fiber contents during initial laundering.

2. The fabric as defined in claim 1, said fabric having a basis weight of from about 50 to about 135 grams per square meter.

3. The fabric as defined in claim 2, said substrate being formed of continuous filament yarns knit together in stitches in an ordered array of courses and wales, and having a construction density of from about 0.2 to about 1.4 stitches × gram/cm⁴.

4. The fabric as defined in claim 2, said substrate being a woven scrim formed of continuous filament yarns and having from about 2 to 12 picks per inch.

5. The fabric as defined in claim 2, said substrate being a cross-warp of continuous filaments.

6. The fabric as defined in claim 5, said cross-warp being formed in at least one direction from continuous filament yarns.

7. The fabric as defined in claim 1, said fabric being a corduroy fabric having a basis weight of from about 100 to about 200 grams per square meter, said substrate being a cross-warp of continuous filaments.

8. A process for making a composite fabric of low basis weight exhibiting a high edge strength and low loss of fiber during initial laundering comprising:

(a) forming continuous filament yarns into an ordered cross-directional array, said yarns being free of filament interentanglement and twist which would prevent ready separation of the filaments from one another;

(b) placing a sheet formed of staple fibers of less than 0.3 tex per filament and from about 0.5 cm to about 1 cm in length over said array of continuous filament yarns;

(c) impinging the staple fibers and array of continuous filament yarns with columnar streams of liquid to spread the yarns so that the filaments are well spread and have a spaced-apart relationship throughout the array in at least one direction and so that the staple fibers interentangle with said continuous filaments to form an integral composite fabric, said filaments being well spread provided that the average spacing between any bundles of filaments is no larger than the average width of said bundles of filaments, said filaments having a spaced-apart relationship provided that in the densest observed area of the filament cross section the sum of the areas of the filament cross sections occupies less than 30% of the densest observed area of the cross section; and (d) impinging the fabric so formed with columnar streams of liquid from the reverse side of the fabric to further interentangle the staple fibers, thereby forming more than about 2 reversals in the staple fibers in the direction between the faces of the fabric per cm of staple fiber length.

* * * * *

UNITED STATES PATENT OFFICE

CERTIFICATE OF CORRECTION

PATENT NO. : 4,190,695

DATED : Feb. 26, 1980

INVENTOR(S) : Donald O. Niederhauser

It is certified that error appears in the above-identified patent and that said Letters Patent are hereby corrected as shown below:

Cover sheet, Change "34 Drawing Figures" to -- 36 Drawing Figures --.

Col. 15, line 68, Change "indicted" to -- indicated --.

Col. 16, line 1, Change "mμ" to -- μm --.

Col. 17, line 35, Change "mμ" to -- μm --.

Col. 18, line 10, Change "mμ" to -- μm --.

Col. 19, Table II, Figure No. 14 - First cycle, pass 1
Change "$18.3^{C}$" to -- $8.3^{C}$ --.

Col. 21, Table II, Figure No. 16 - Third cycle, pass 2
Change "8.3" to -- 12.4 --.

Col. 23, line 63, Change "of the cross-section" to
-- of the bundle cross-section --.

Col. 26, line 1, Change "of the filament cross-section" to
-- of the filament bundle cross-section --.

Col. 26, line 4, Change "of the cross-section" to
-- of the bundle cross-section --.

Signed and Sealed this

*Fifth* Day of *August 1980*

[SEAL]

*Attest:*

SIDNEY A. DIAMOND

*Attesting Officer* *Commissioner of Patents and Trademarks*